US008821070B2

(12) United States Patent
Benard et al.

(10) Patent No.: US 8,821,070 B2
(45) Date of Patent: Sep. 2, 2014

(54) METHOD FOR CONSTRUCTING A RISER ASSEMBLY FROM A VESSEL AND ON A SEABED

(75) Inventors: Cornelis Benard, Leiden (NL); Cristian Rogier Koene, Leiden (NL); Eduard Wiersema, Leiden (NL); Frank Cornelis Lange, Leiden (NL)

(73) Assignee: Heerema Marine Contractors Nederland SE (NL)

( * ) Notice: Subject to any disclaimer, the term of this patent is extended or adjusted under 35 U.S.C. 154(b) by 0 days.

(21) Appl. No.: 13/577,350

(22) PCT Filed: Feb. 10, 2011

(86) PCT No.: PCT/NL2011/050093

§ 371 (c)(1),
(2), (4) Date: Aug. 6, 2012

(87) PCT Pub. No.: WO2011/099852

PCT Pub. Date: Aug. 18, 2011

(65) Prior Publication Data

US 2012/0318379 A1 Dec. 20, 2012

Related U.S. Application Data

(60) Provisional application No. 61/303,114, filed on Feb. 10, 2010, provisional application No. 61/393,490, filed on Oct. 15, 2010.

(51) Int. Cl.

| | |
|---|---|
| ***F16L 1/12*** | (2006.01) |
| ***E21B 17/01*** | (2006.01) |
| ***E21B 19/00*** | (2006.01) |

(52) U.S. Cl.

CPC ..... *E21B 17/01* (2013.01); *E21B 17/012* (2013.01); *E21B 19/002* (2013.01)

USPC ..... 405/171

(58) Field of Classification Search

USPC ..... 405/154.1, 158, 171; 166/350, 367, 166/338, 344, 351, 352, 385, 85.1; 441/3–5; 114/230.12, 230.13

See application file for complete search history.

(56) References Cited

U.S. PATENT DOCUMENTS

| | | | | |
|---|---|---|---|---|
| 4,098,333 | A | 7/1978 | Wells et al. | |
| 4,423,982 | A * | 1/1984 | Zaremba | 405/224.2 |
| 4,906,139 | A * | 3/1990 | Chiu et al. | 405/223.1 |
| 5,778,981 | A | 7/1998 | Head | |
| 2005/0241832 | A1 | 11/2005 | Jones et al. | |
| 2009/0044950 | A1 | 2/2009 | Boudreau | |
| 2009/0297277 | A1 | 12/2009 | Alliot | |

FOREIGN PATENT DOCUMENTS

WO WO 03/070561 A1 8/2003

* cited by examiner

*Primary Examiner* — Sean Andrish
*Assistant Examiner* — Patrick Lambe
(74) *Attorney, Agent, or Firm* — John S. Sopko, Esq.; Hoffmann & Baron, LLP

(57) ABSTRACT

A method for constructing a riser assembly (1) for transporting a fluid from a vessel and on a seabed includes providing an elongate frame (4) having a first frame end (5) and a second frame end (6), where the first frame end is connected to the seabed (3) and the second frame end is connected to a buoy (7), providing at least one riser (9) for transporting a fluid, and connecting the at least one riser to the second frame end and/or the buoy.

13 Claims, 34 Drawing Sheets

METHOD FOR CONSTRUCTING A RISER ASSEMBLY FROM A VESSEL AND ON A SEABED

CROSS-REFERENCE TO RELATED APPLICATIONS

This application is the National Stage of International Application No. PCT/NL2011/050093, filed Feb. 10, 2011, which claims the benefit of U.S. Provisional Application Nos. 61/303,114, filed Feb. 10, 2010, and 61/393,490, filed Oct. 15, 2010, the contents of all which are incorporated by reference herein.

FIELD OF THE INVENTION

The object of the invention is to provide an improved or at least an alternative method for constructing a riser assembly from a vessel and on a seabed. Furthermore, the object of the invention is to provide an improved or at least an alternative riser assembly.

The invention relates to a method for constructing a riser assembly for transporting a fluid from a vessel and on a seabed, comprising providing an elongate frame comprising a first frame end and a second frame end, wherein the first frame end is connected to the seabed and the second frame end is connected to a buoy, providing at least one riser for transporting a fluid, and connecting the at least one riser to the second frame end and/or the buoy.

SUMMARY OF THE INVENTION

The method may comprise connecting the at least one riser to the second frame end and/or the buoy at a location near the circumference of the buoy.

The method may comprise connecting the at least one riser to the second frame end and/or the buoy at a location adjacent to the circumference of the buoy.

The method may comprise connecting the at least one riser to the buoy at a location on the circumference of the buoy.

The method may comprise any feature disclosed in the claims and/or figures and/or description of this patent application.

The invention relates to a riser assembly for transporting a fluid, said riser assembly comprising an elongate frame comprising a first frame end and a second frame end, wherein the first frame end is connected to a seabed and the second frame end is connected to a buoy, and at least one riser for transporting a fluid, wherein the at least one riser is connected to the second frame end and/or the buoy.

The at least one riser may be connected to the second frame end and/or the buoy at a location near the circumference of the buoy.

The at least one riser may be connected to the second frame end and/or the buoy at a location adjacent to the circumference of the buoy.

The at least one riser may be connected to the buoy at a location on the circumference of the buoy.

The riser assembly may comprise any feature disclosed in the claims and/or figures and/or description of this patent application.

In an embodiment according the invention, the elongate frame may comprise a longitudinal frame axis.

The buoy may comprise at least two buoy elements.

The buoy may comprises at least three buoy elements.

The at least two buoy elements may be located substantially in line with the longitudinal frame axis.

At least a part of the buoy elements may be connected to the second frame.

At least one buoy element may be connected to the at least one buoy element connected to the second frame end.

At least one buoy element may be connected to at least one of the further buoy elements.

At least two of the buoy elements may be interconnected.

All the buoy elements may be interconnected.

All the buoy elements may be connected to the second frame end.

The elongate frame may comprise a longitudinal frame axis, the at least two buoy elements may comprise a first buoy element located substantially in line with the longitudinal frame axis.

The first buoy element and at least a part of the buoy elements may be located in a fictive plane extending transverse to the longitudinal frame axis.

The first buoy element and at least a part of the buoy elements may be located in a fictive plane extending substantially perpendicular to the longitudinal frame axis.

The first buoy element may be at least partly surrounded by further buoy elements.

The first buoy element may be substantially fully surrounded by further buoy elements.

The elongate frame may comprise a longitudinal frame axis and the buoy may comprise at least three buoy elements which may be located substantially in line with the longitudinal frame axis.

All the buoy elements may be located substantially in line with the longitudinal frame axis.

The buoy may comprise a first buoy element and a second buoy element which are constructed such that the buoyancy of the second buoy element is larger than the first buoy element.

The buoy may comprise a first buoy element and at least two further buoy elements which are constructed such that the buoyancy of the at least two further buoy elements is larger than the first buoy element.

At least one riser may be connected to at least one buoy element.

At least one riser may be connected to multiple buoy elements.

At least one riser may be connected to all the buoy elements.

BRIEF DESCRIPTION OF THE DRAWINGS

Embodiments of the invention will be described by way of example only, with reference to the accompanying schematic drawings in which corresponding reference symbols indicate corresponding parts, and in which:

the FIGS. 1-7 depict a first embodiment of a riser assembly according to the invention, the FIGS. 8 and 9 depict two alternative embodiments of the riser assembly of the FIGS. 1-7, the FIGS. 10-20 depict an embodiment of the method of constructing the riser assemblies according the FIGS. 1-9 and 22, the FIG. 21 depicts an embodiment of the method for disassembling the riser assemblies according the FIGS. 1-9 and 22, the FIG. 22 depicts a further alternative embodiment of the riser assembly of the FIGS. 1-7, the FIG. 23 depicts an alternative embodiment of the riser assembly of the FIGS. 1-7, the FIG. 24 depicts an alternative embodiment of the riser assembly of the FIGS. 1-7, the FIG. 25 depicts an alternative embodiment of the riser assembly of the FIGS. 1-7, the FIG. 26 depicts an alternative embodiment of the riser assembly of the FIGS. 1-7, the FIG. 27 depicts an alternative embodiment of the riser assembly of the FIGS. 1-7, the FIGS. 28 and 29 depict an alternative embodiment of the riser assembly of the FIGS. 1-7, the FIG. 30 depicts an alternative embodiment of the riser assembly of the FIGS. 1-7, the FIG. 31 depicts two alternative embodiments of the riser assembly of the FIGS. 1-7, the FIG. 32 depicts an alternative embodiment of the riser assembly of the FIGS. 1-7, the FIGS. 33-40 depict an embodiment of the method of constructing the riser assembly according FIG. 25, the FIG. 41 depicts an alternative embodiment of the riser assembly of the FIGS. 1-7, the FIG. 42 depicts an alternative embodiment of the riser assembly of the FIGS. 1-7, and the FIGS. 43 and 44 depict an alternative embodiment of the riser assembly of the FIGS. 1-7.

DETAILED DESCRIPTION OF THE INVENTION

Figure 3:
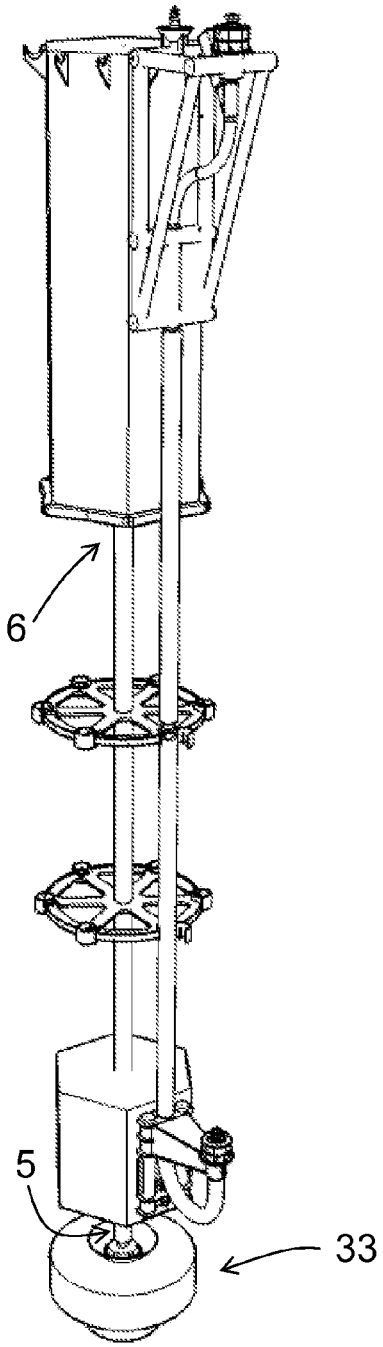
Figure 4:
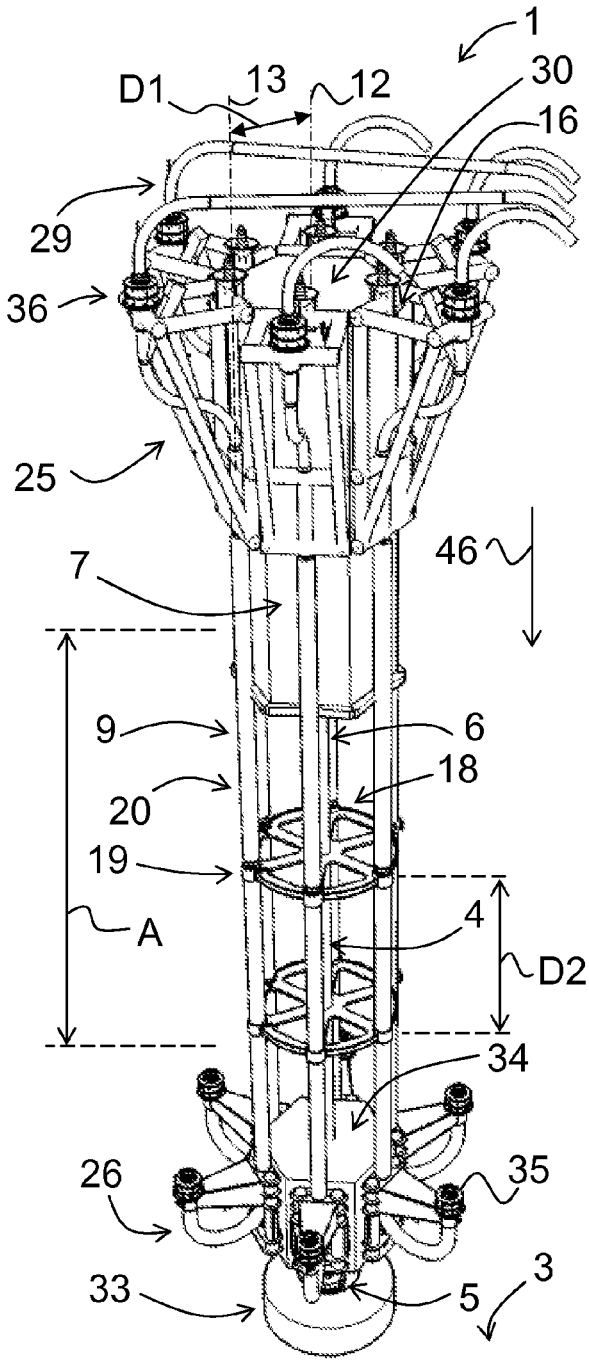

The FIGS. 1-7 schematically show a first embodiment of a riser assembly according to the invention. The riser assembly 1 shown in FIG. 4 is constructed on a seabed 3. The riser assembly 1 is used primarily used for transferring oil and/or gas. Although throughout this document the use for transportation of a fluid and/or oil and/or gas is mentioned, it shall be clear to those skilled in the art that besides transportation of a fluid and/or oil and/or gas, one or more of the total number of risers may also be used for other purposes, for instance service lines, water injection lines, gas lift lines and the like.

The riser assembly 1 comprises an elongate frame 4 with a first frame end 5 and a second frame end 6. The first frame end 5 is connected to the seabed 3 via a foundation 33. The first frame end 5 is connected to the foundation 33 such that the frame 4 can pivot in any direction relative to the foundation 33. This is in FIG. 2 indicated by arrow 50.

The second frame end 6 is connected to a buoy 7. Six risers 9 for transporting a fluid are connected to the buoy 7, but this can be any number of risers 9. More specifically, the risers 9 are connected at a location on the circumference 10 of the buoy 7. The risers 9 may also be connected to the second frame end 6 and/or the buoy 7 at a location near the circumference 10 of the buoy 7. The risers 9 may also be connected to the second frame 6 end and/or the buoy 7 at a location adjacent to the circumference 10 of the buoy 7. Each riser 9 comprises an inlet 35 and an outlet 36 for fluid.

The elongate frame 4 comprises a longitudinal frame axis 12. Each riser 9 comprises a longitudinal riser axis 13. The longitudinal riser axis 13 extends substantially parallel to the longitudinal frame axis 12. The risers 9 are connected to the buoy 7 such that said risers 9 surround the longitudinal frame axis 12. The longitudinal riser axis 13 of each riser 9 is located at a distance D1 of several meters from the longitudinal frame axis 12, depending on the diameter of the buoy 7. The longitudinal riser axis 13 of each riser 9 may be located at a distance D1 of at least 1 m and at the most 10 m from the longitudinal frame axis 12.

The risers 9 are suspending from a support device 16 provided on the buoy 7. The elongate frame 4 comprises multiple spacers 18 for holding the risers 9. The spacers 18 are positioned at a distance from each other along the longitudinal frame axis 12. The risers 9 are held by the spacers 18. The part the frame 4 and risers 9 indicated by A is in the FIGS. 1-4 shortened for clarity reasons. In practice said part A may be several kilometers long. It will be understood that in said situation a large number of spacers 18 is used. The spacers 18 ensure that the risers 9 remain in their place relative to the frame 4 when the frame 4 pivots. The distance D2 between the spacers 18 may be more than 20 m and less than 200 m.

The spacers 18 hold the risers 9 such that the movement of the risers 9 relative to the frame 4 and in a direction perpendicular to the longitudinal frame axis 12 is limited. The spacers 18 hold the risers 9 such that the risers 9 are movable in the direction of the longitudinal riser axis 13. This allows the risers 9 to shrink or elongate in the direction of the longitudinal riser axis 13 under the influence of temperature differences.

The risers 9 comprise a first riser end 25 which is located near the second frame end 6 and/or the buoy 7 and a second riser end 26 which is connected to the frame 4 near the first frame end 5. The frame 4 comprises a connection member 34 located near the first frame end 5. The risers 9 are connected to the connection member 34 such that the risers 9 are movable in the direction of the longitudinal riser axis 13.

Figure 1:
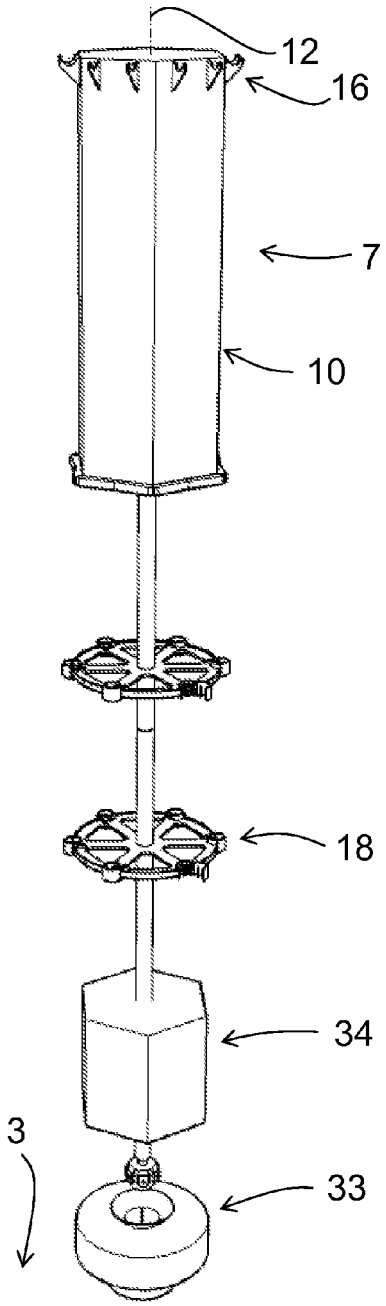
Figure 2:
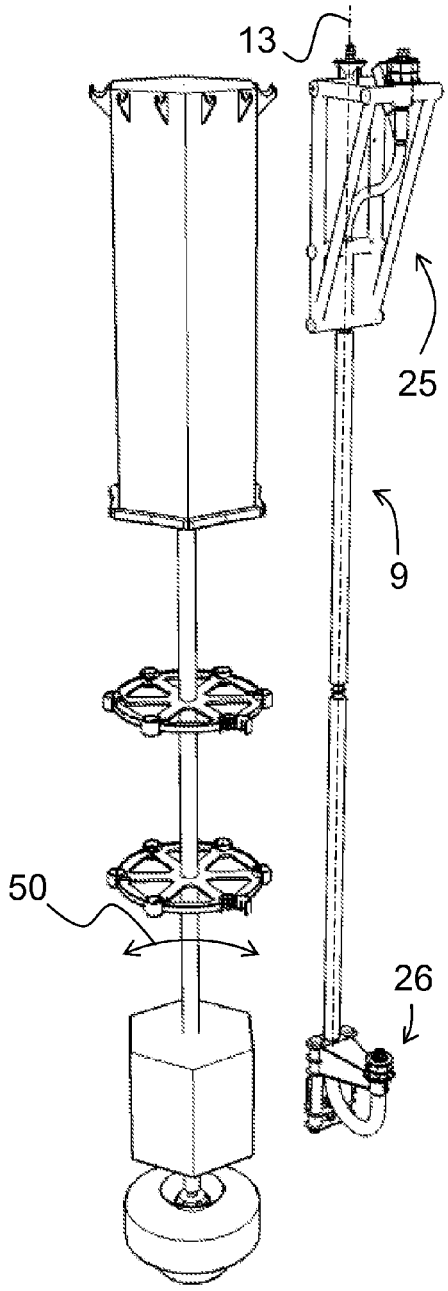

The steps indicated in FIGS. 1-4 show an embodiment of the construction of the riser assembly 1 according the invention. In FIG. 1 the foundation 33 is provided in the seabed 3. Furthermore, the frame 4 with at its second frame end 6 the thereto connected buoy 7 is provided. The frame 4 may be built up from tendon elements. The tendon elements may be connected by mechanical connectors or via welding. The frame 4 comprises spacers 18 and a connection member 34. The first frame end 5 is connected to the foundation 33 in FIG. 2. A riser 9 is built up from an installation vessel and positioned besides the frame 4 and buoy 7. In FIG. 3 the riser 9 is placed on the support device 16 provided on the buoy 7. The riser 9 is suspending from the buoy 7. In FIG. 4 six risers 9 are placed in their installed position 20. Jumpers 29 can be provided on top of the risers 9. Another possibility is to install oil and/or gas processing equipment, for instance manifolds, directly on the top 30 of the buoy 7. Further details of these steps are shown in the FIG. 10-20.

It will be clear that the risers 9 may be connected to the second frame end 6. The risers 9 may be connected to the second frame end 6 and/or the buoy 7 at a location near the circumference 10 of the buoy 7. The riser 9 may be connected to the second frame end 6 and/or the buoy 7 at a location adjacent to the circumference 10 of the buoy 7.

Figure 5:
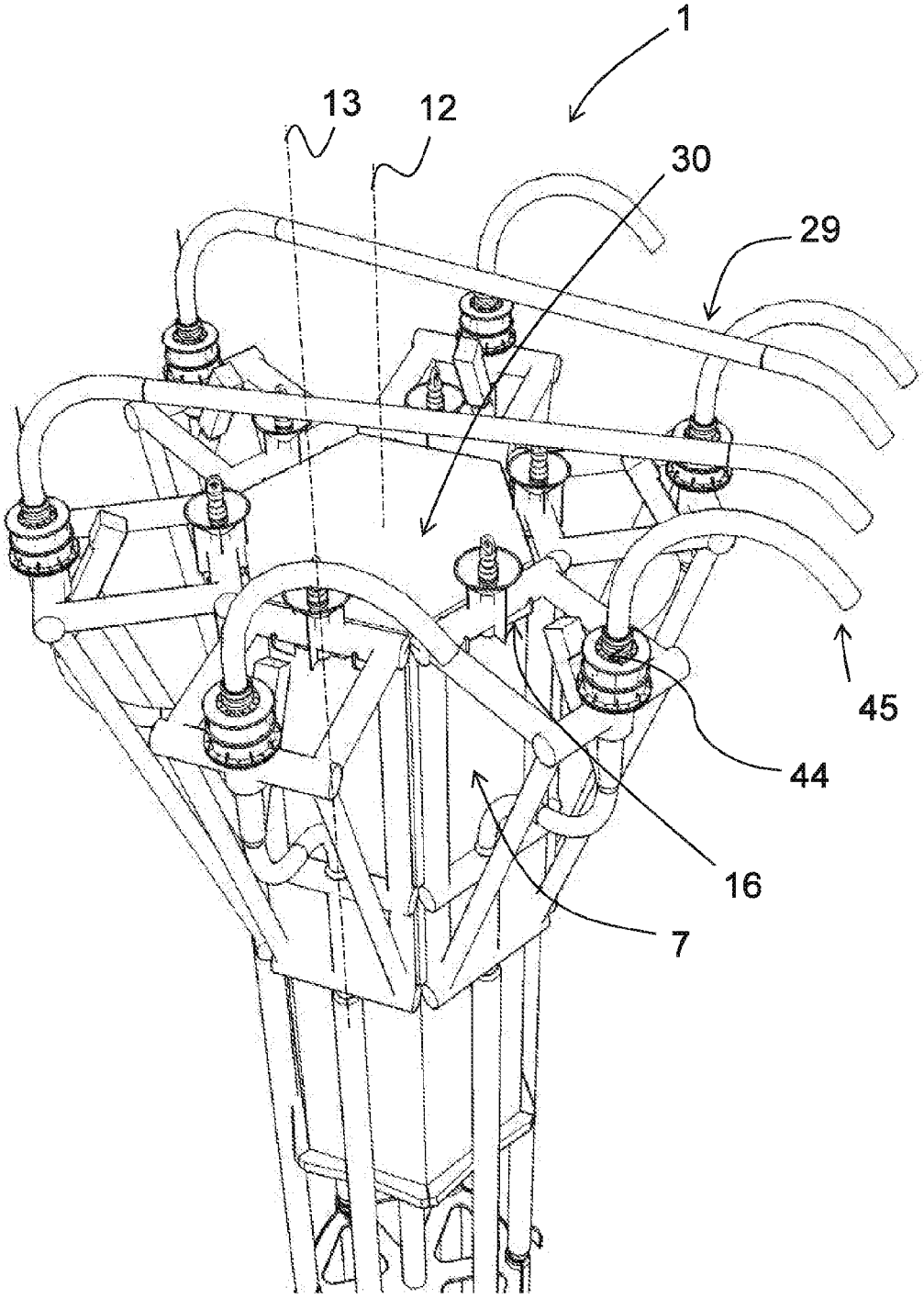

FIG. 5 shows an enlarged view of the top part of the riser assembly 1. It shows the various jumpers 29 connected with a first jumper end 44 to the top of the risers 9. All jumpers 29 are with their second jumper end 45 oriented towards one side of the buoy 7. This allows flexible jumpers (not shown) which connect the second jumper end 45 to a floating production unit to depart in the same direction without interfering with the buoy 7. Another layout of the jumper configuration is possible as well.

Figure 6:
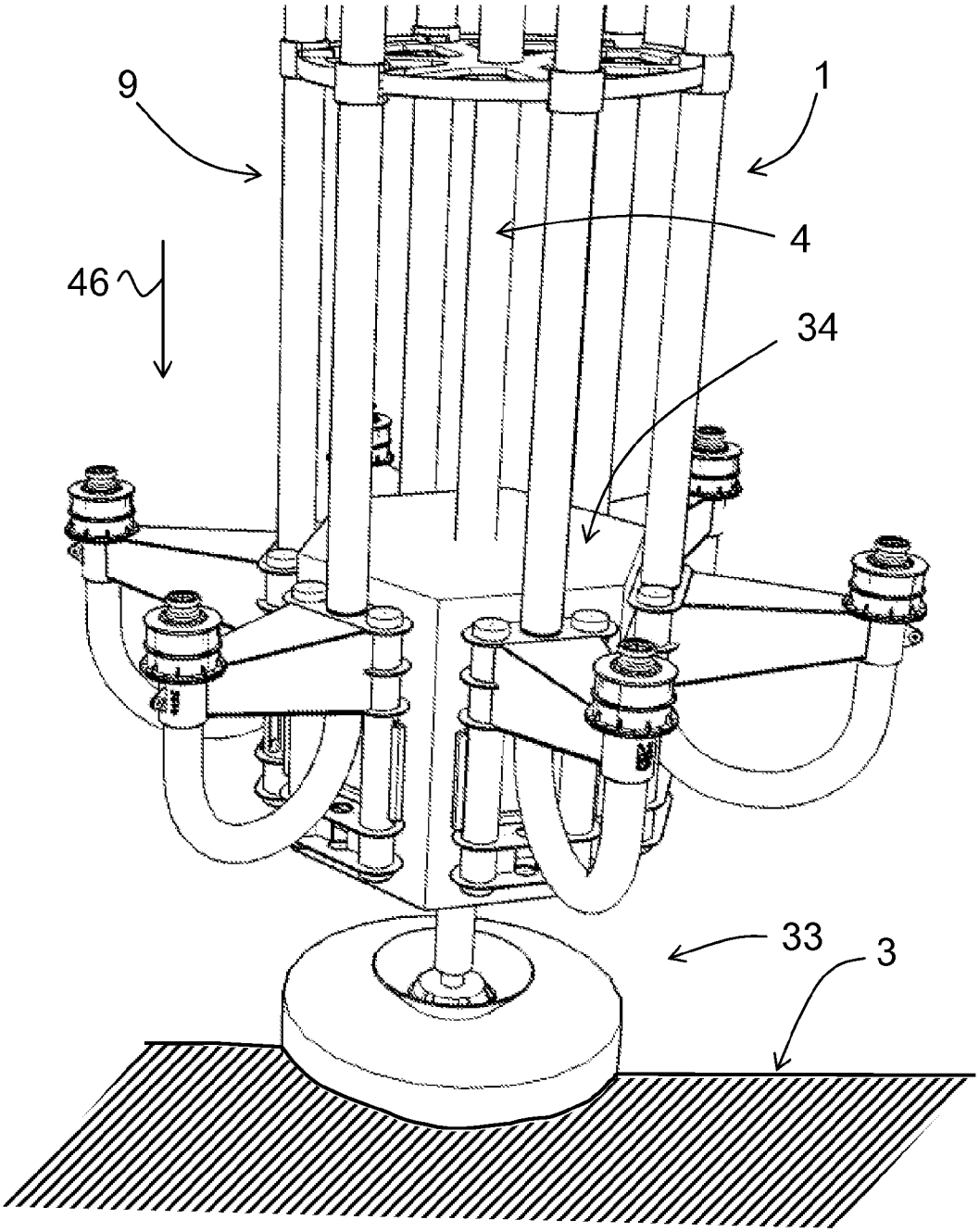

FIG. 6 shows an enlarged view of the lower part of the riser assembly 1. Here the connections for jumpers (not shown) to connect the risers to flowlines are shown.

Figure 7A:
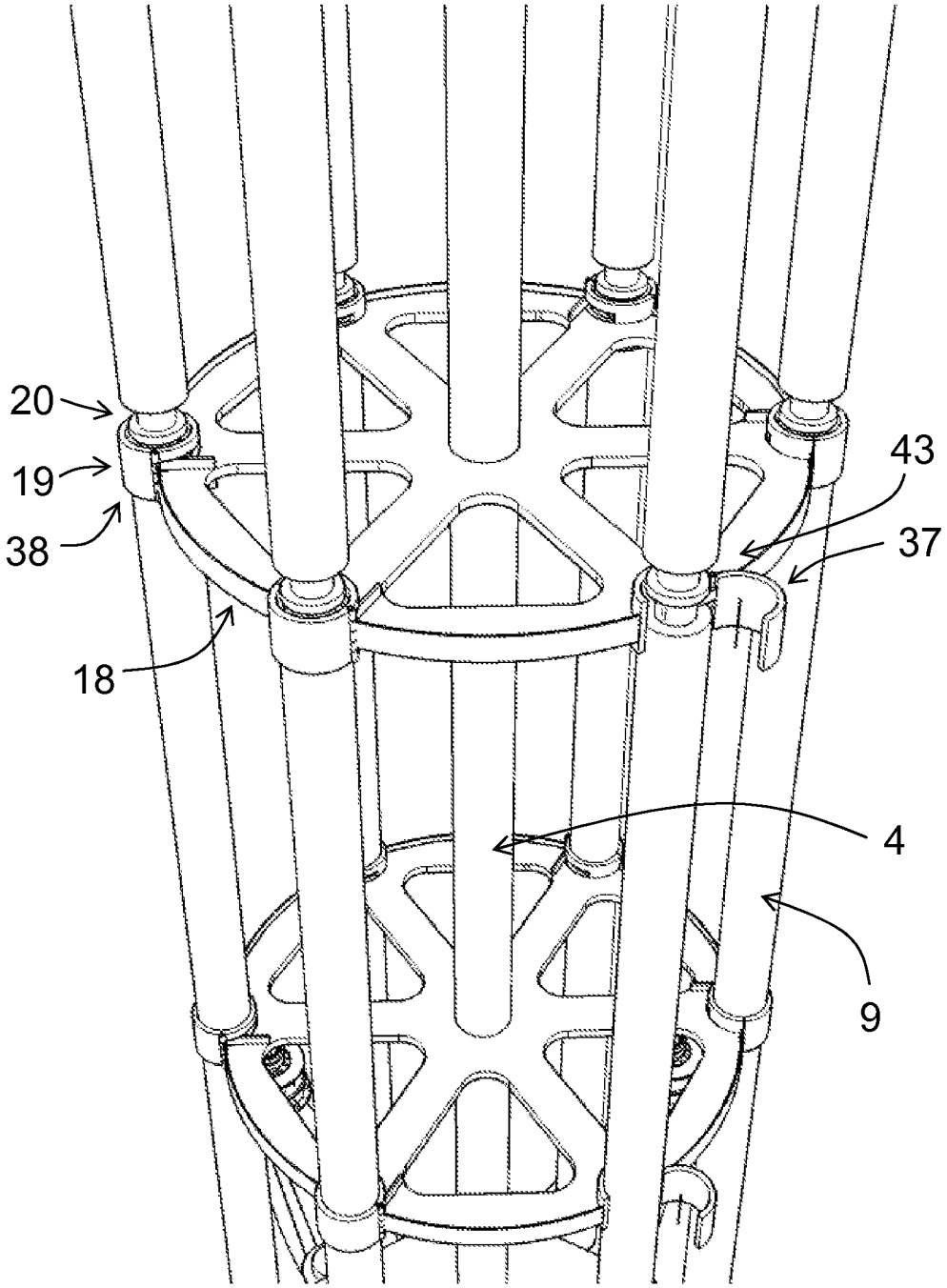
Figure 7B:
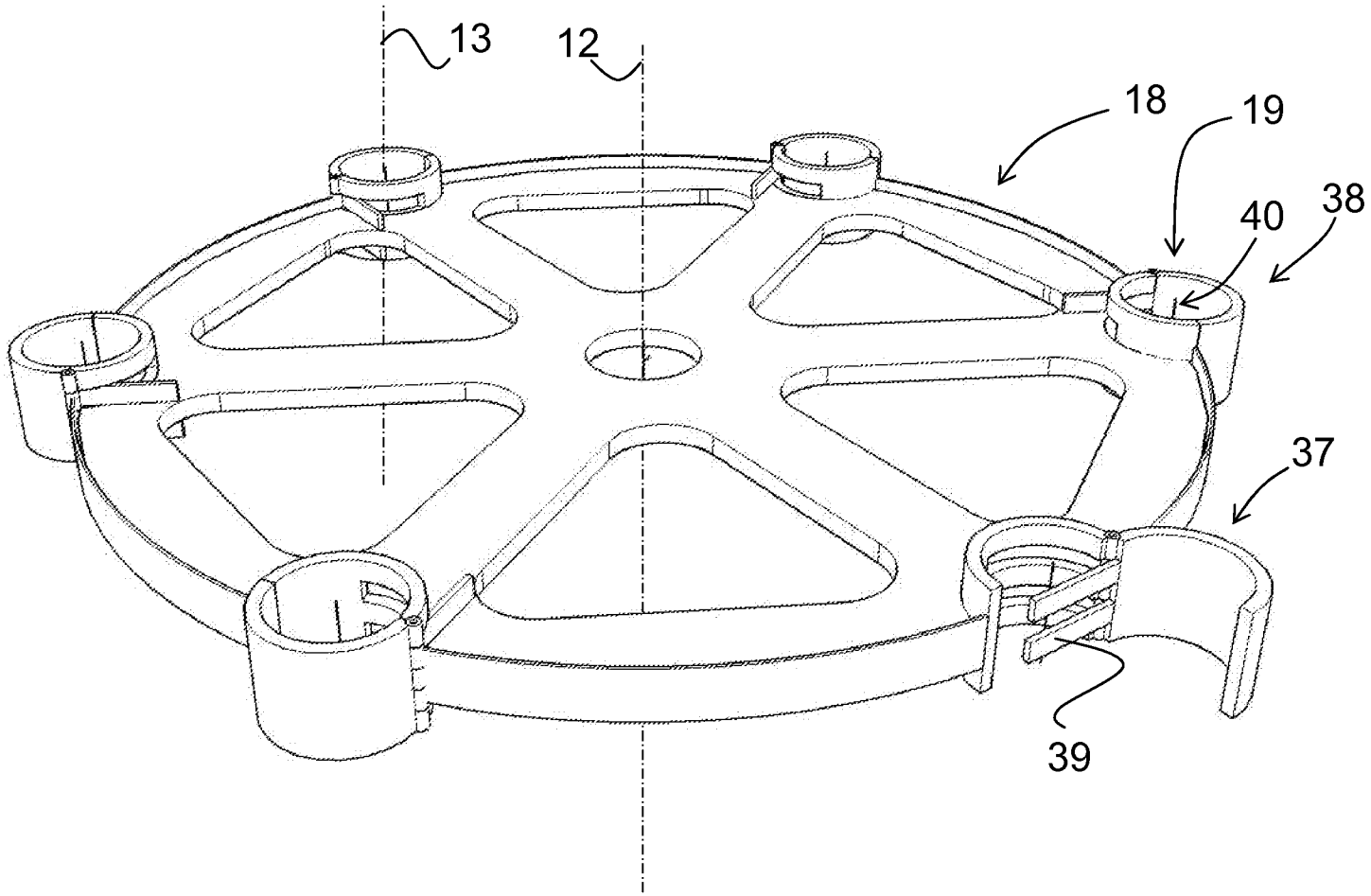

FIG. 7 *a* and b show an enlarged view of one embodiment of the spacers 18 of the riser assembly 1. The spacers 18 comprise limiters 19 for limiting the movement of a riser 9 held by the limiters 19. When held by the limiters 19, the riser 9 is located in the installed position 20. The limiters 19 hold the risers 9 such that they are movable in the direction of the longitudinal riser axis 13 and that a movement in a direction perpendicular to the longitudinal riser axis 13 is limited.

In FIG. 7 the limiters 19 are movable from an open position 37 into a holding position 38 and vice versa. In the holding position 38, the limiters 19 fully surround the riser 9. The limiters 19 comprise closing protrusions 39 which automatically move the limiters 19 from the open position 37 into the holding position 38 when the riser 9 is moved into the centre 40 of the limiter 19. The riser 9 is moved into the centre 40 by first positioning the riser 9 besides the frame 4 and/or the buoy 7 and subsequently moving the riser 9 in a direction transverse to the longitudinal frame axis 12. Other embodiments of the limiters are possible as well, which do not require any moving parts, see for instance FIGS. 8 and 9.

Figure 8:
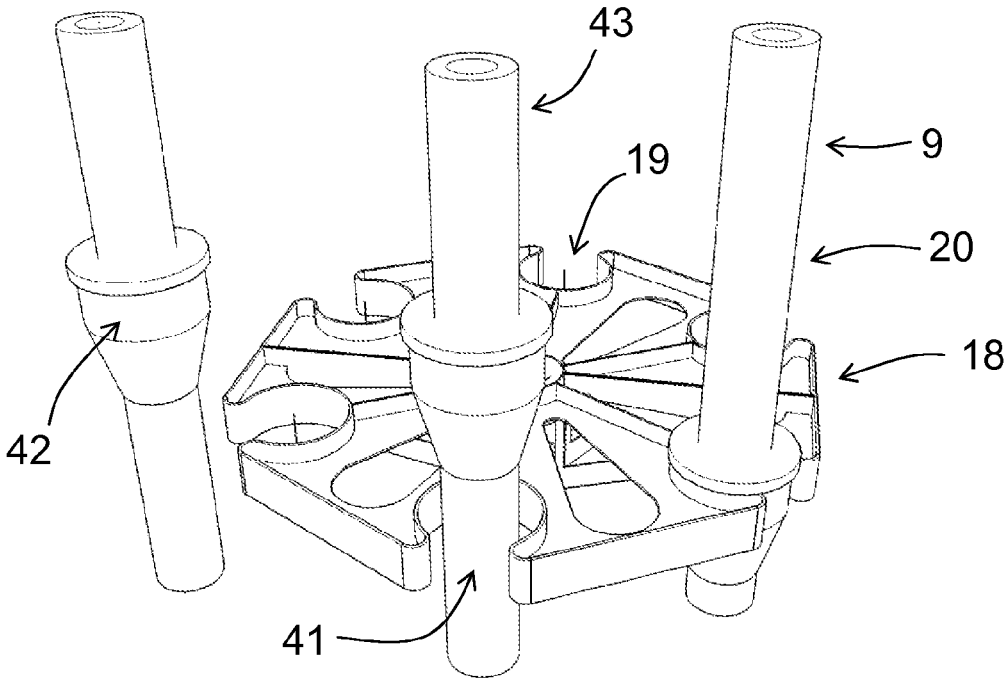
Figure 9:
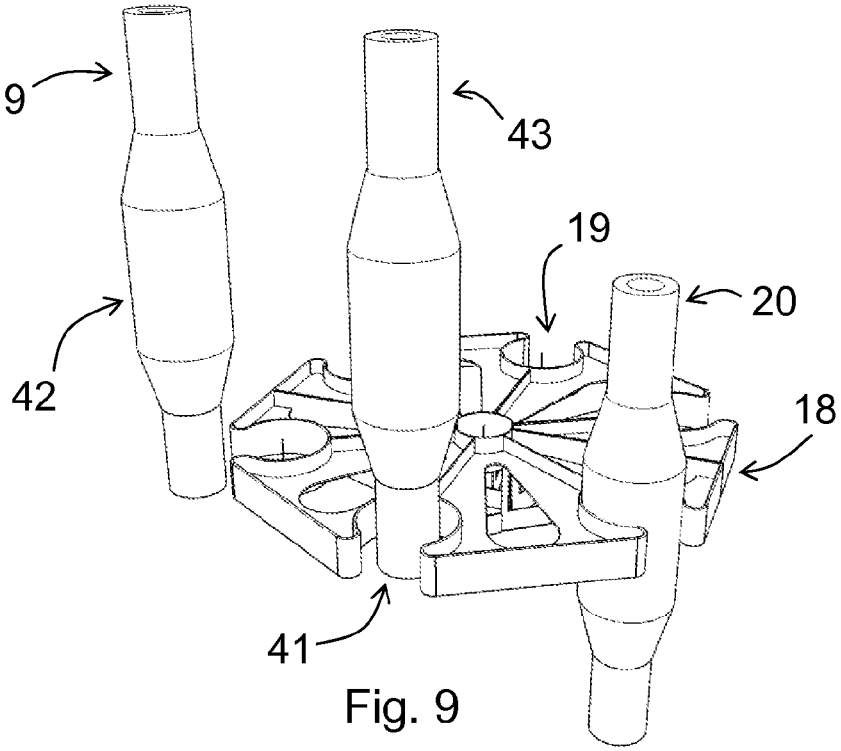

The FIGS. 8 and 9 show two alternative embodiments of the riser assembly 1 of the FIGS. 1-7. The spacers 18 comprise limiters 19 comprising a limiter opening 41. The risers 9 comprise radial extending protruding members 42. The dimensions of the limiter 19, the limiter opening 41, the riser 9 and the radial extending protruding members 42 are chosen such that the riser 9 and the protruding members 42 can be received by the limiter 19. In said situation the riser 9 and the protruding members 42 are located in the received position 43. In the received position 43, the riser 9 can pass through the limiter opening 41 and the protruding members 42 can not pass through the limiter opening 41. In the received position 43, the riser 9 is or the riser 9 and protrusion 39 are due to the limiter opening 41 partly surrounded by the limiter 19. When the limiter 19 surrounds the protruding members 39, the movement of the riser 9 in the direction perpendicular to the longitudinal riser axis 13 is limited and the riser 9 is in the installed position 20.

This means that a riser 9 located in the received position 43 can be moved into and out of the installed position 20 by moving the riser 9 in the direction of the longitudinal riser axis 13 such that the protruding members 42 are moved into and out of the received position 43, respectively.

Figure 10:
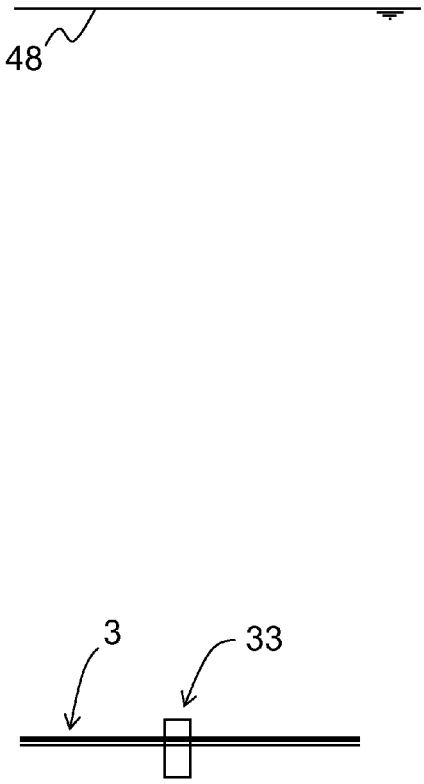
Figure 11:
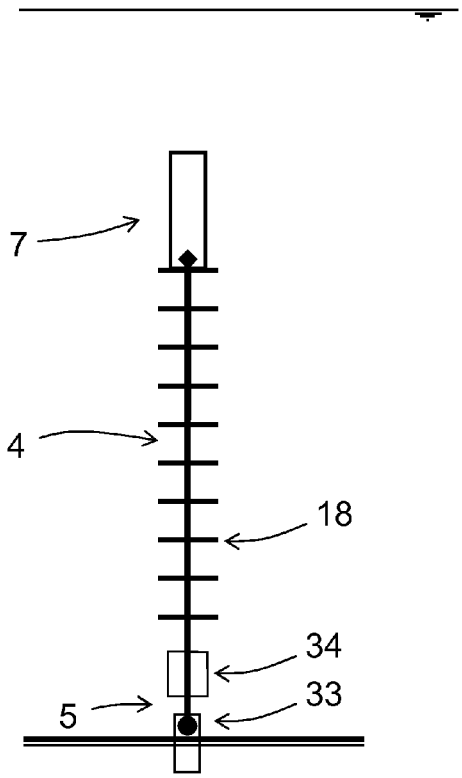
Figure 12:
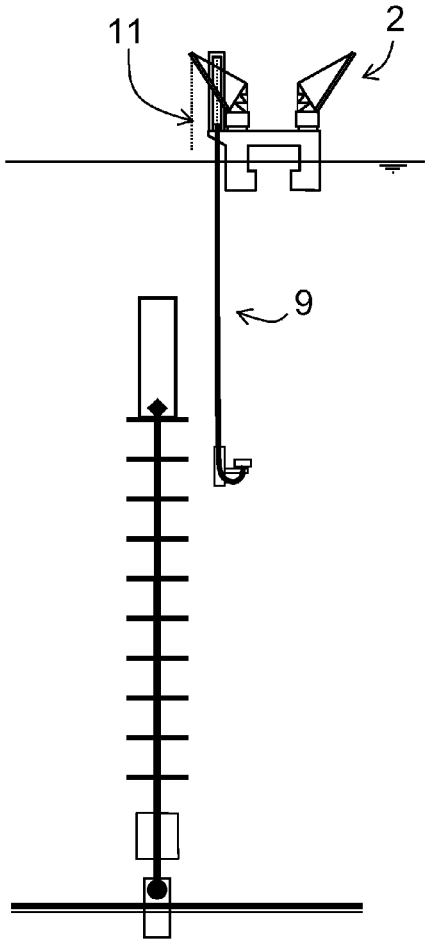
Figure 13:
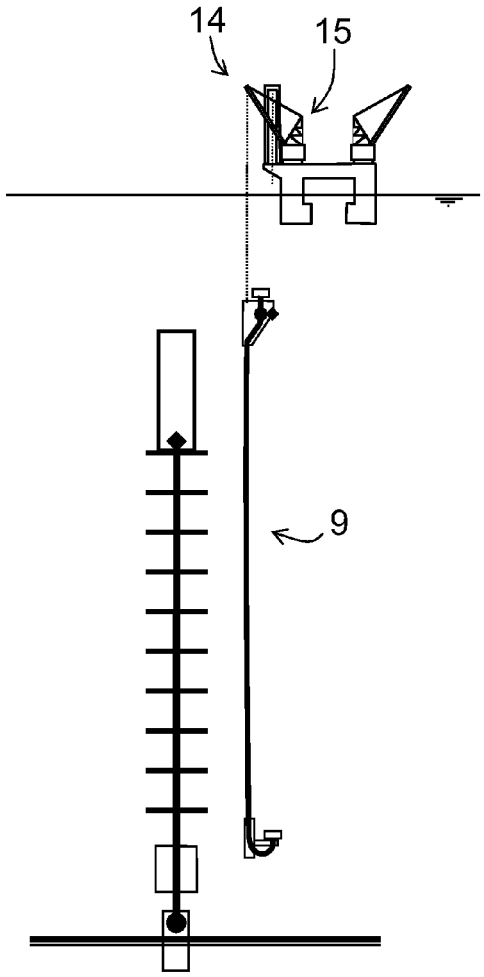
Figure 14:
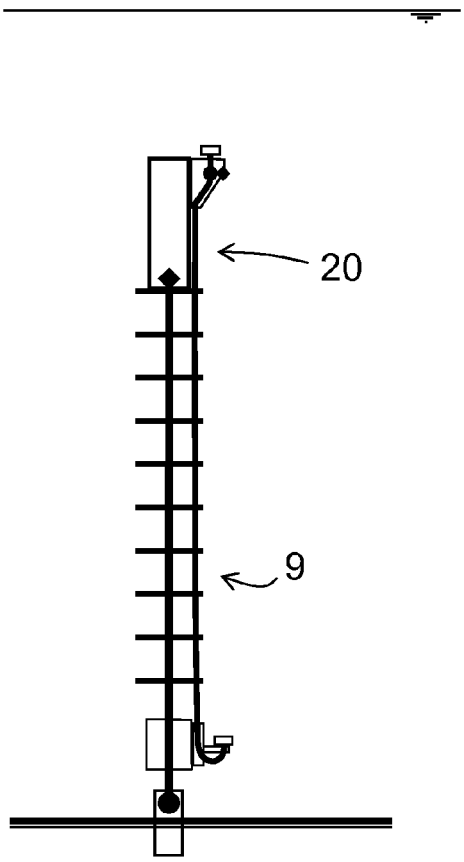
Figure 15:
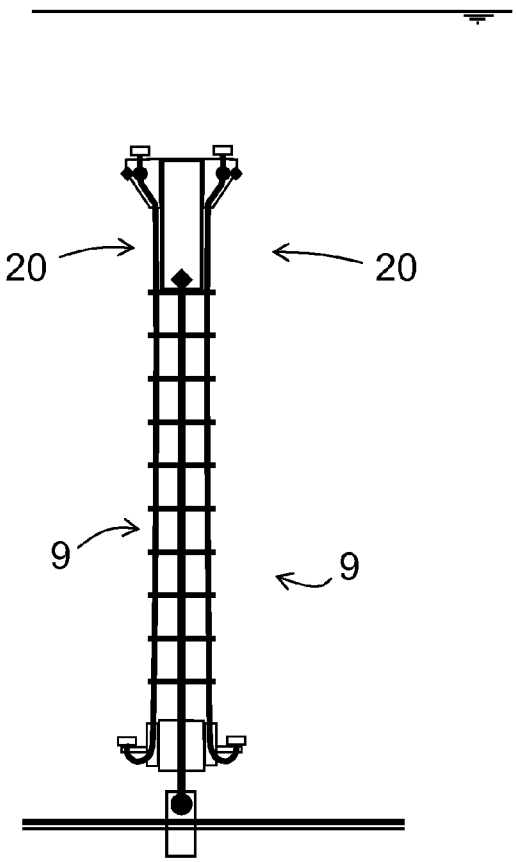
Figure 16:
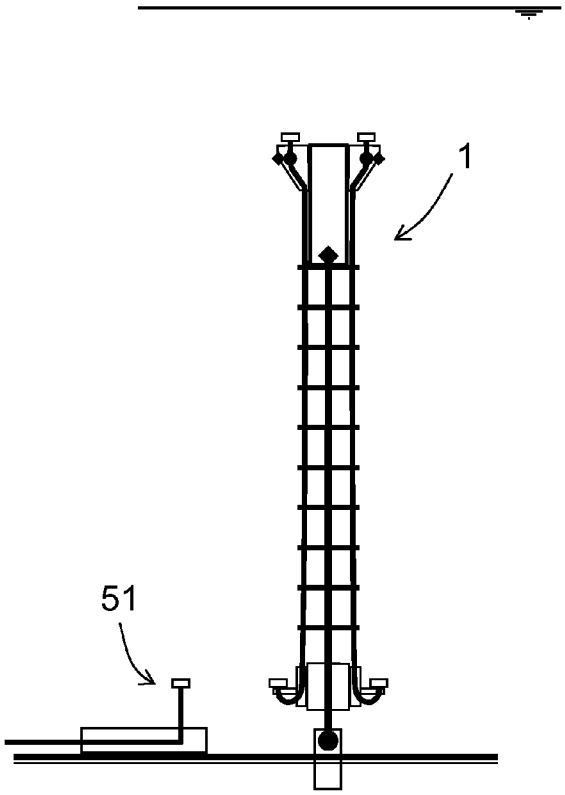
Figure 17:
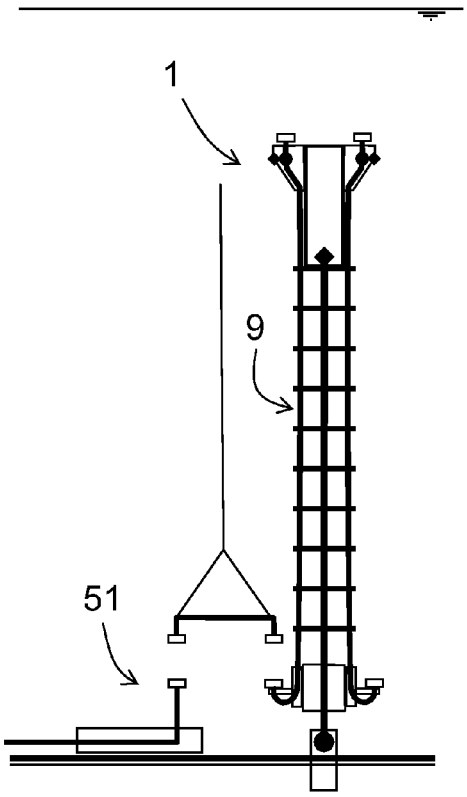
Figure 18:
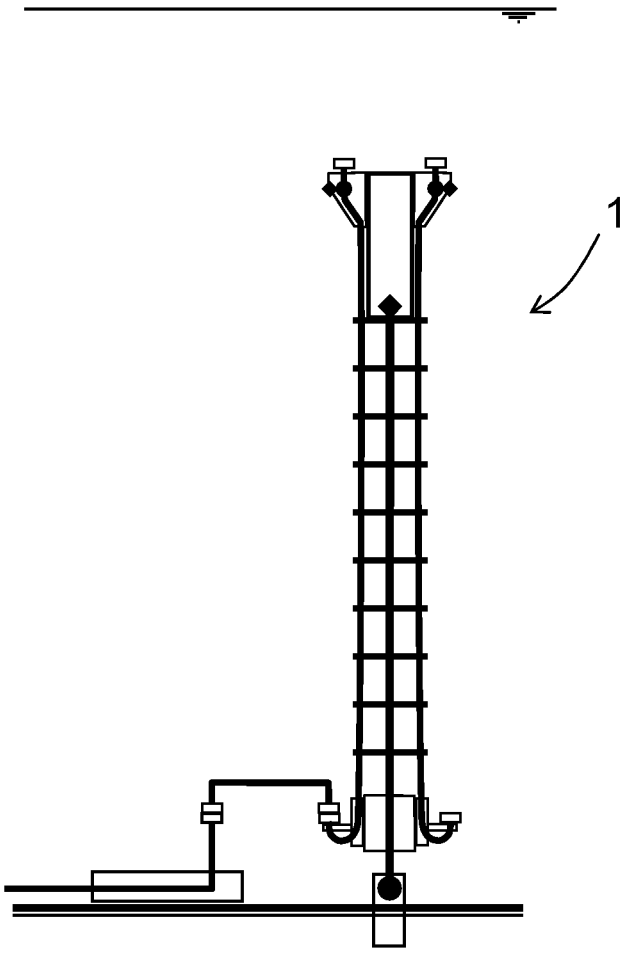
Figure 19:
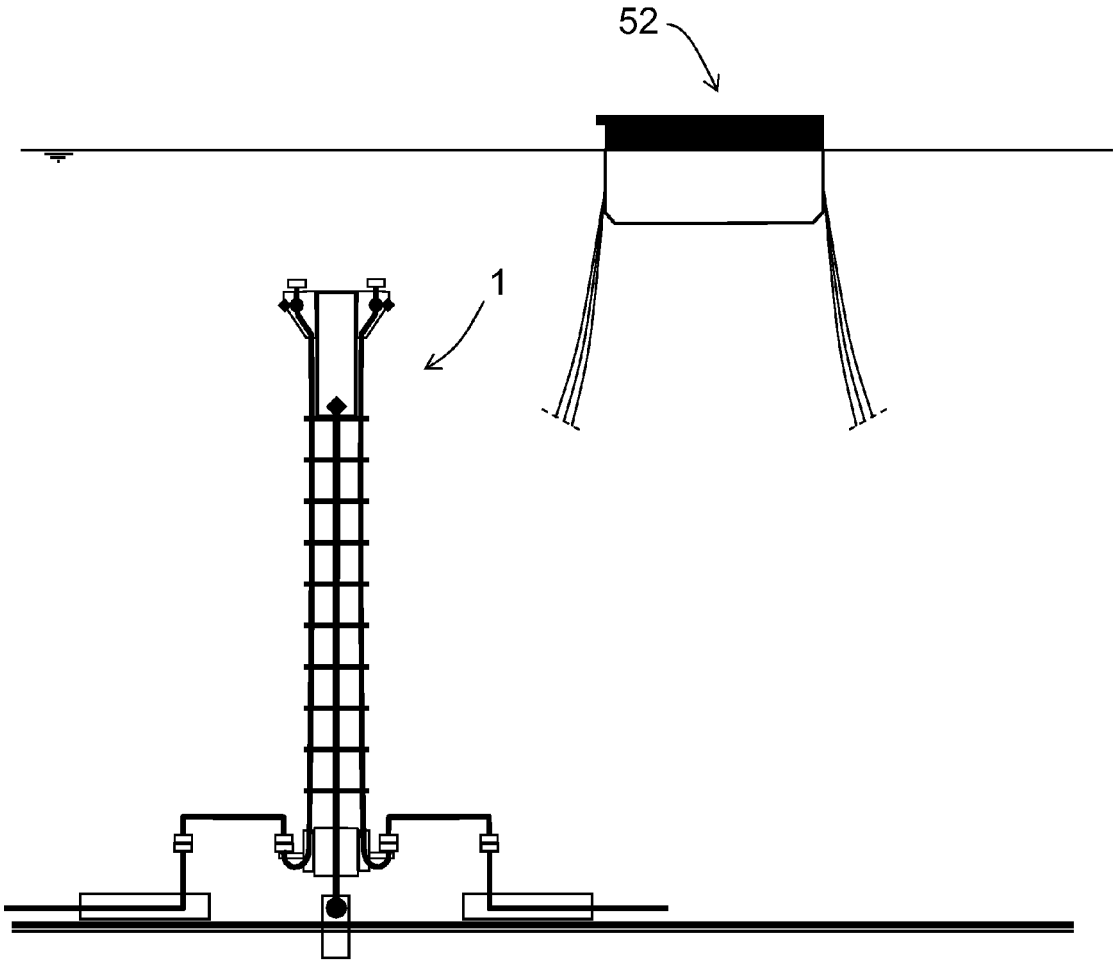
Figure 20:
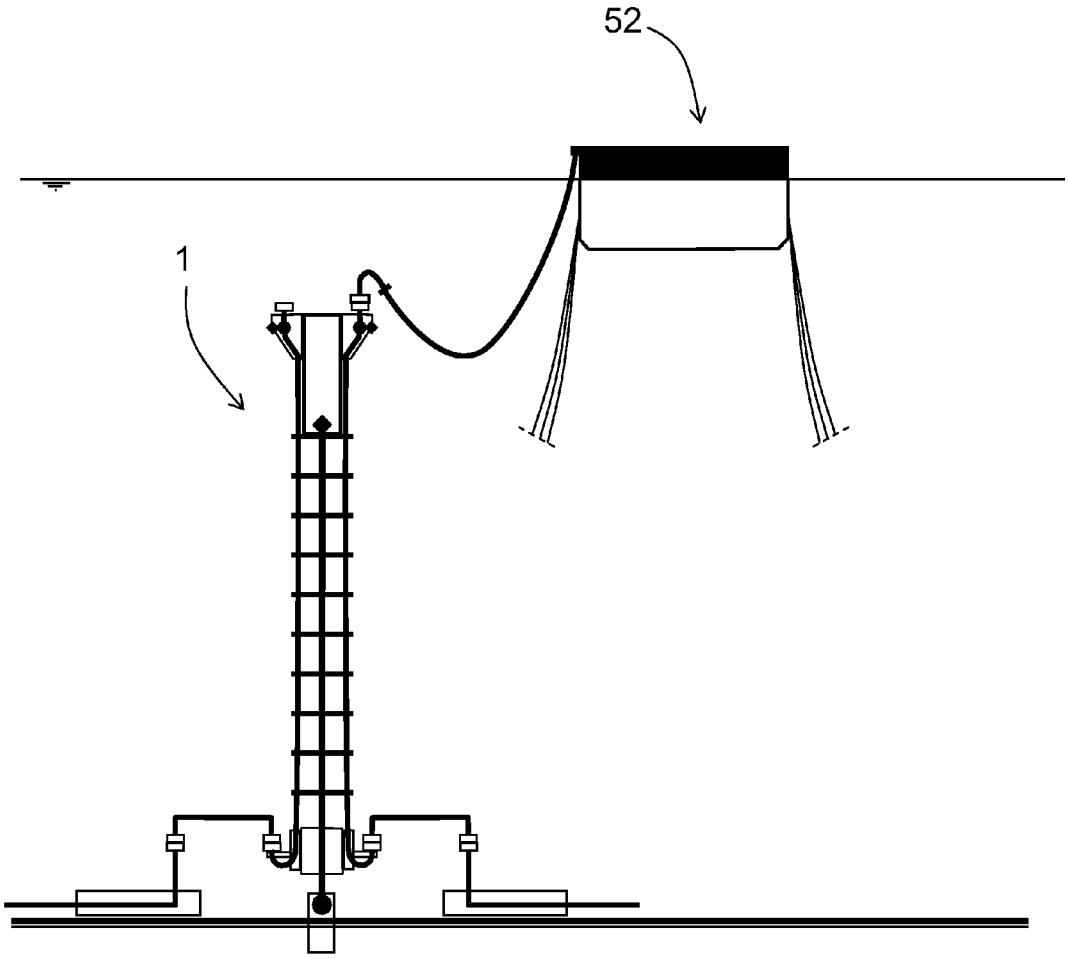
Figure 21:
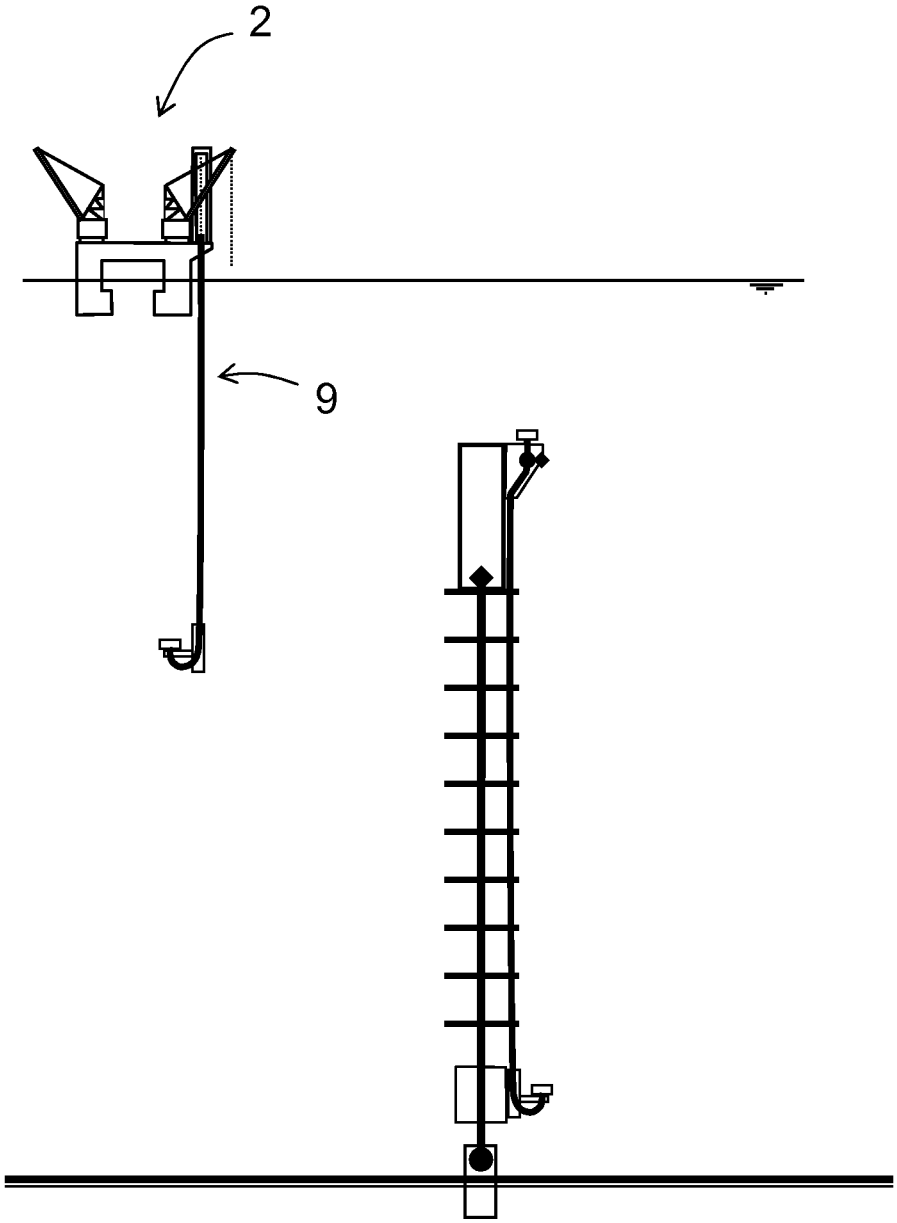

The FIGS. 10-20 show an embodiment of the method of constructing the riser assemblies according the FIGS. 1-9 and 22. In FIG. 10 the waterline 48 and the seabed 3 are shown. A foundation 33, which can for instance be a suction pile, a driven pile or a ballast foundation, is provided in the seabed 3. In FIG. 11 the frame 4 and buoy 7 are connected to the seabed 3 via a connector at first frame end 5. The connector is locked in a receptacle provided on the foundation 33. The frame 4 may consist of tendon elements. The tendon elements may be connected via mechanical connectors or via welding. In FIG. 12 a riser 9 is constructed on a vessel 2 by a J-lay pipeline construction process 11. A different pipeline construction process may be used. In FIG. 13 the riser 9 is suspending from a crane 15 provided on the vessel 2. A different lifting device 14 may be used. The riser 9 is positioned besides the frame 2 and buoy 7. The vessel 2 is used to move the riser 9 toward the frame 4 in a direction transverse to the longitudinal frame axis 12. In FIG. 14 the riser 9 is connected to buoy 7 and placed in the installed position 20. FIG. 15 shows the situation after the steps of FIG. 10-14 are repeated to connect more risers 9 to the buoy and place them into the installed position. In FIG. 16 a pipeline 51 for transporting a fluid along the seabed 3 is provided and terminated near the riser assembly 1. The pipeline 51 is in the FIGS. 17 and 18 connected to one of the risers 9 by means of a jumper. In FIG. 19 more pipelines 51 are connected to risers 9 via flexible jumpers. A floating production unit 52 is moored at a distance from the riser assembly 1. In FIG. 20 the floating production unit 52 is connected to one of the risers 9 via a flexible jumper. The floating production unit 52 will also be connected to the other risers 9. In FIG. 21 the riser assembly 1 is disassembled from a vessel 2, wherein basically a reversed working order for installation is followed.

Figure 22A:
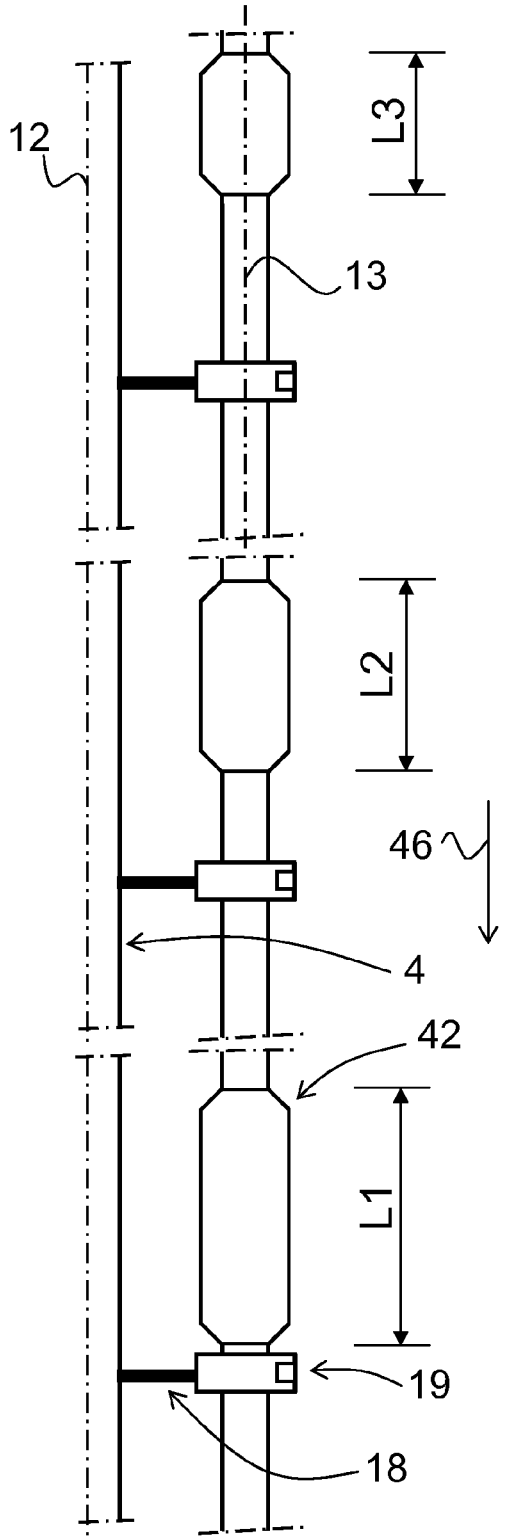
Figure 22B:
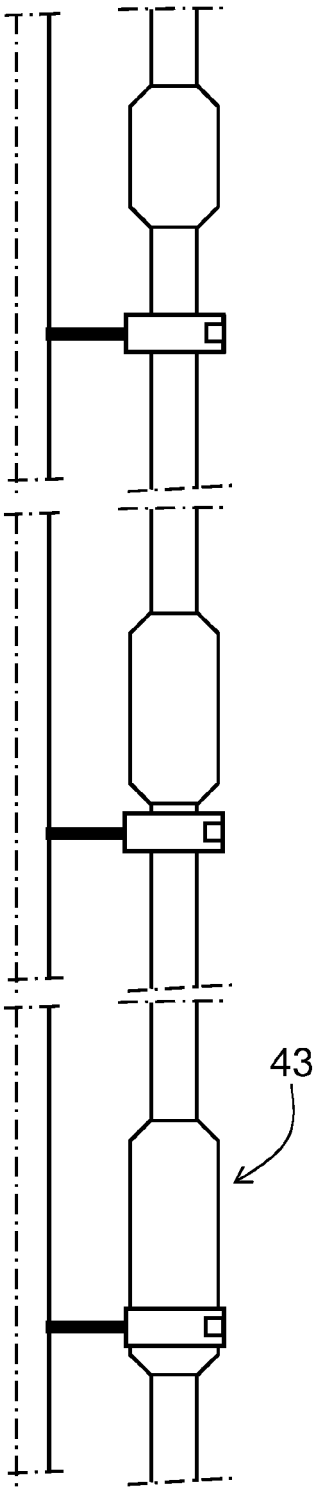
Figure 22C:
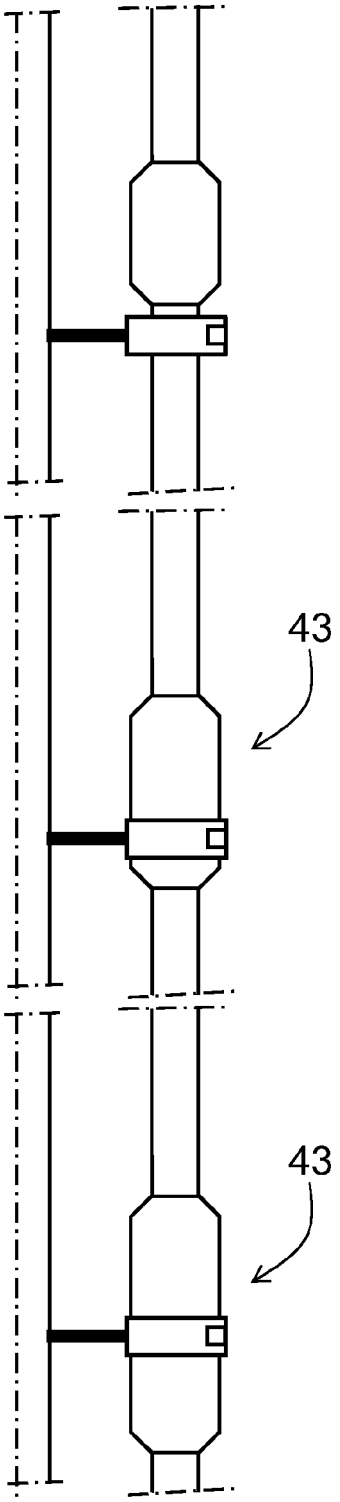
Figure 22D:
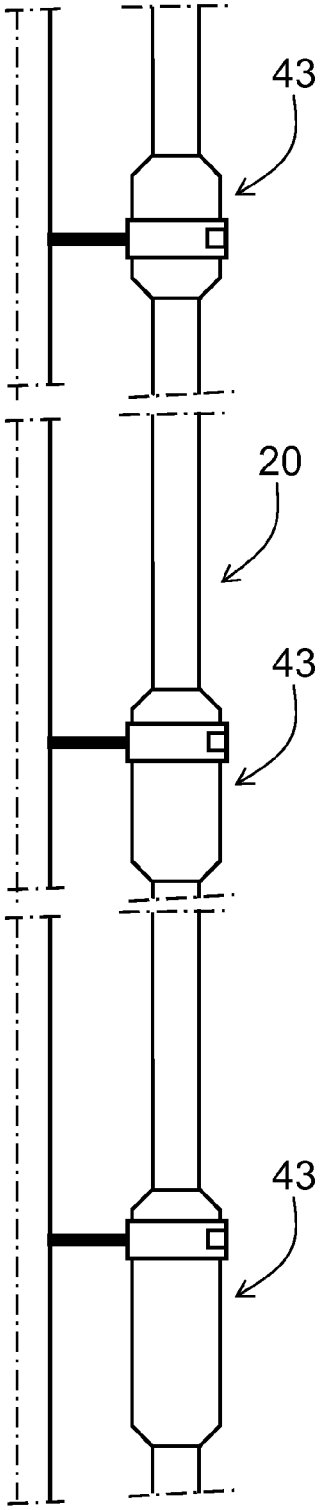

The FIGS. 22*a-d* show a further alternative embodiment of the riser assembly of the FIGS. 1-7. Each protruding member 42 has a different length L1, L2, L3 in which the protruding members 42 extend along a longitudinal riser axis 13. The FIGS. 22*a-d* show that the riser 9 is moved in a first direction 46 of the longitudinal riser axis 13 such that the protruding members 42 are successively placed in the received position 43. In FIG. 22*a* none of the protruding members 42 is located in the received position 43. The riser 9 is subsequently moved in the direction 46. In FIG. 22*b* only the lowermost protruding member 42 is located in the received position. In FIG. 22*c* the riser 9 is moved further and the lowermost and the middle protruding members 42 are located in the received position 43. In FIG. 22*d* the riser 9 is moved further and the three protruding members 42 are located in the received position 43. When all protruding member 42 are located in the received position 43, the riser is located in the installed position 20.

Figure 23:
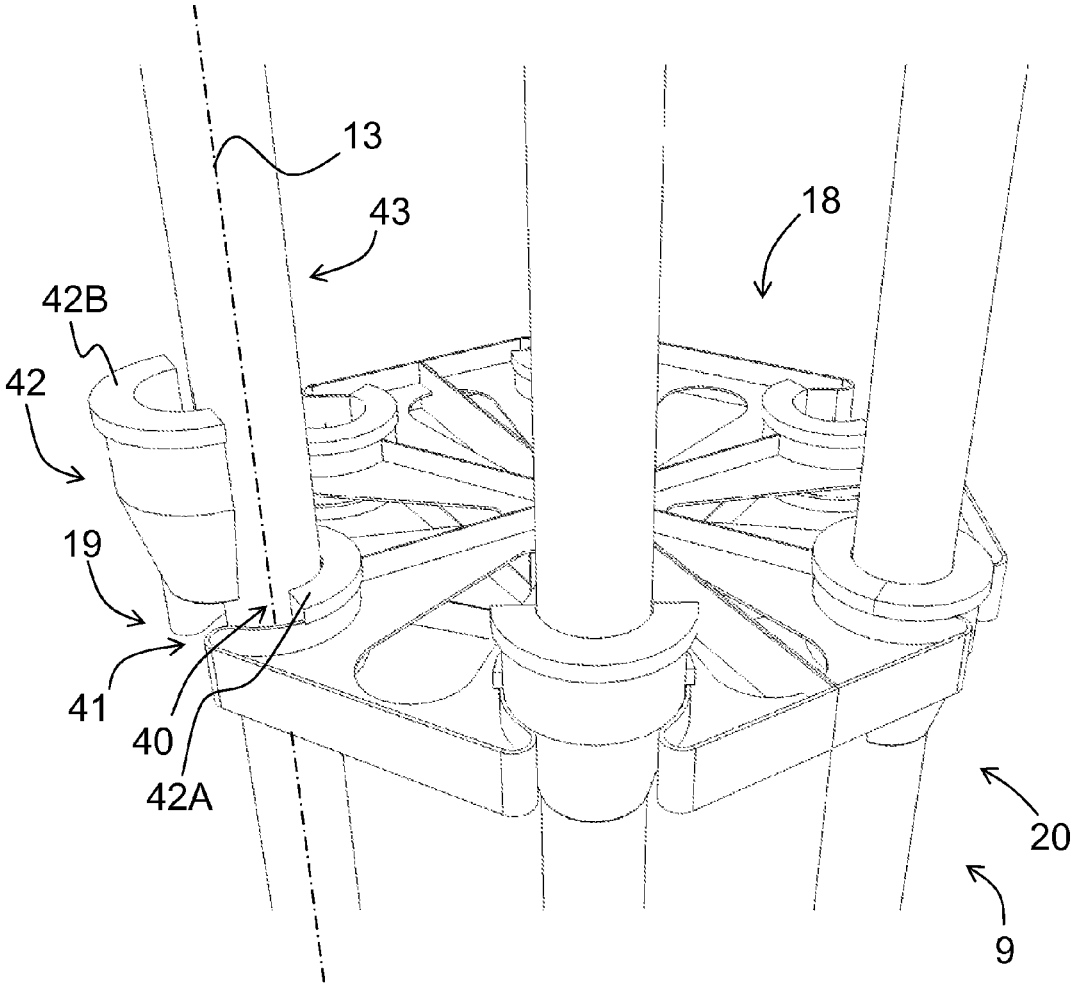

FIG. 23 schematically shows an enlarged view of an alternative embodiment of the spacers 18 of the riser assembly 1 of FIGS. 1-7. For clarity reasons the length of the schematically shown riser assembly 1 is shortened. As indicated before, the total length of the riser assembly 1 may be several kilometers.

The spacers 18 comprise limiters 19 comprising a limiter opening 41. The risers 9 comprise radial extending protruding members 42. Each protruding member 42 comprises a first member 42A and a second member 42B. The first member 42A is placed in the limiter 19 before the riser 9 is positioned in the receiving position 43.

The first member 42A may be placed in the limiter 9 before the spacer 18 is placed in the seawater. The first member 42A may for example be placed in the limiter 9 on board of the vessel 2 or this may be done onshore prior to transport of the spacer 18 to the vessel 2. After the frame 4 and the spacers 18 are installed on the seabed 3, the riser 9 is positioned in the receiving position 43. Subsequently, the second member 42B is positioned in the limiter 19. The protruding member 42 (formed by the first and second members 42A, B) located in the limiter 19 can not pass through the limiter opening 41. When the riser 9 and the first and second members 42A, B are located in the limiter 19, the riser 9 is located in the installed position 20. In the installed position 20, movement of the riser 9 in the direction perpendicular to the longitudinal riser axis 13 is prevented.

Figure 24:
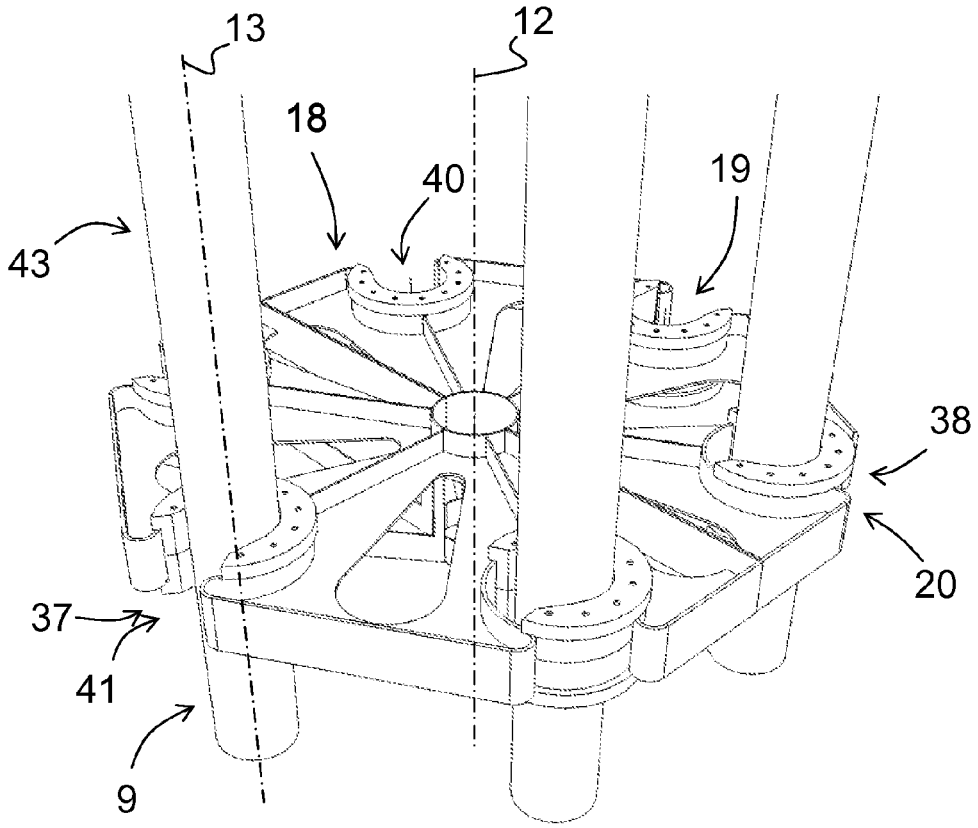

FIG. 24 schematically shows an enlarged view of an alternative embodiment of the spacers 18 of the riser assembly 1 of FIGS. 1-7. The spacers 18 comprise limiters 19 for limiting the movement of a riser 9 held by the limiters 19. When held by the limiters 19, the riser 9 is located in the installed position 20. The limiters 19 hold the risers 9 such that they are movable in the direction of the longitudinal riser axis 13 and that a movement in a direction perpendicular to the longitudinal riser axis 13 is prevented. The limiters 19 are rotatable from an open position 37 into a holding position 38 and vice versa. In the holding position 38, the riser 9 is fully surrounded. In the holding position 38, the riser 9 may be surrounded such that movement of the riser 9 in the direction perpendicular to the longitudinal riser axis 13 is prevented. In the open position 37, the riser 9 is partly surrounded such the riser 9 can be received by the limiter 19.

Figure 25:
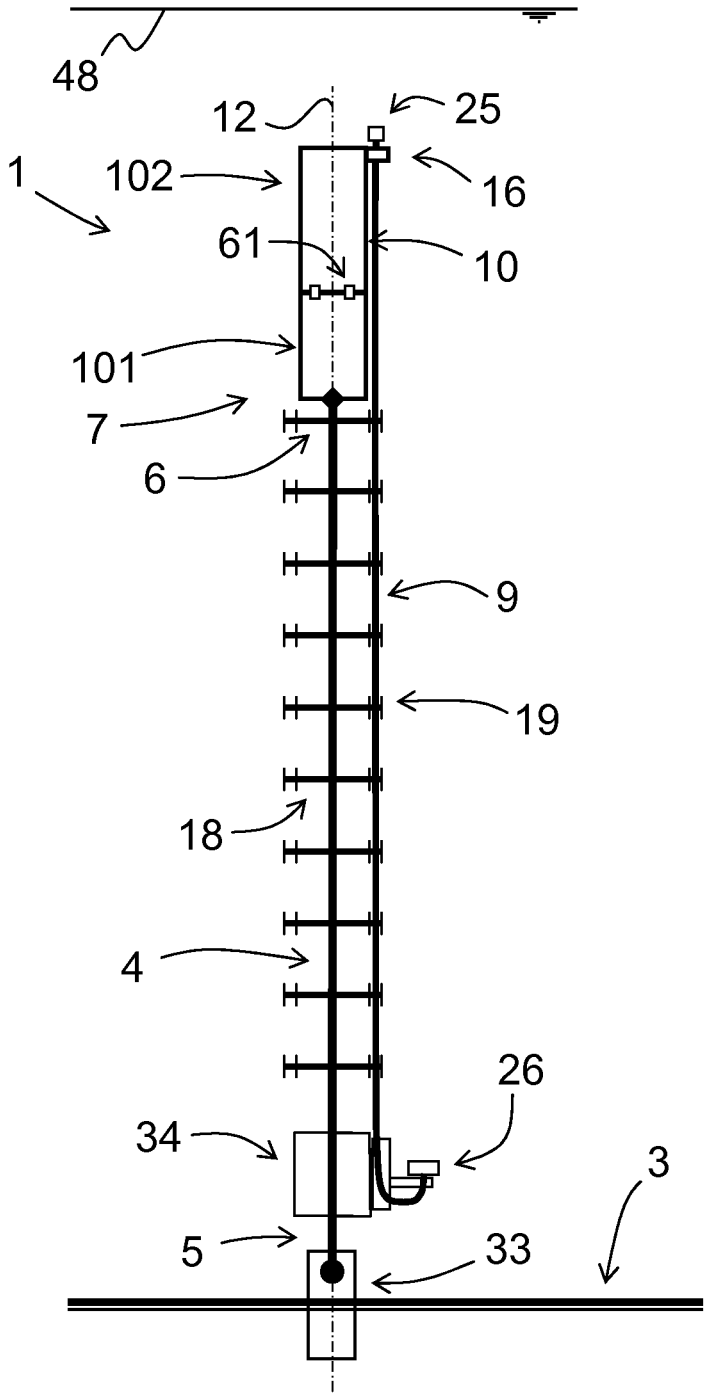

FIG. 25 schematically shows a side view of an alternative embodiment of the riser assembly 1 of FIGS. 1-7. The riser assembly 1 comprises an elongate frame 4 comprising a first frame end 5 and a second frame end 6, wherein the first frame end 5 is connected to a seabed 3 via a foundation 33 and the second frame end 6 is connected to a buoy 7. The buoy 7 comprises a first buoy element 101 and a second buoy element 102. The first buoy element 101 is connected to the second frame end 6. The second buoy element 102 is connected to the first buoy element 101. The second buoy element 102 is in a fixed manner coupled to the first buoy element 101 via a buoy coupler 61. The buoy elements 101, 102 extend in line with the longitudinal frame axis 12 of the frame 4. The second buoy element 102 is positioned on top of the first buoy element 101.

The riser 9 is connected to the circumference 10 of the buoy 7 via a support device 16. More specifically, the riser 19 is connected to the circumference 10 of the second buoy element 102. It will be clear that the riser 9 may also or only be connected to the first buoy element 101. The buoy 7 may comprise more than two buoy elements 101, 102 which are also or only connected to the second frame end 6 and/or the first buoy element 101 and/or the second buoy element 102. The riser 9 may be connected to any of said more than two buoy elements 101, 102. The rise 9 may also or only be connected to the second frame end 6.

Figure 26:
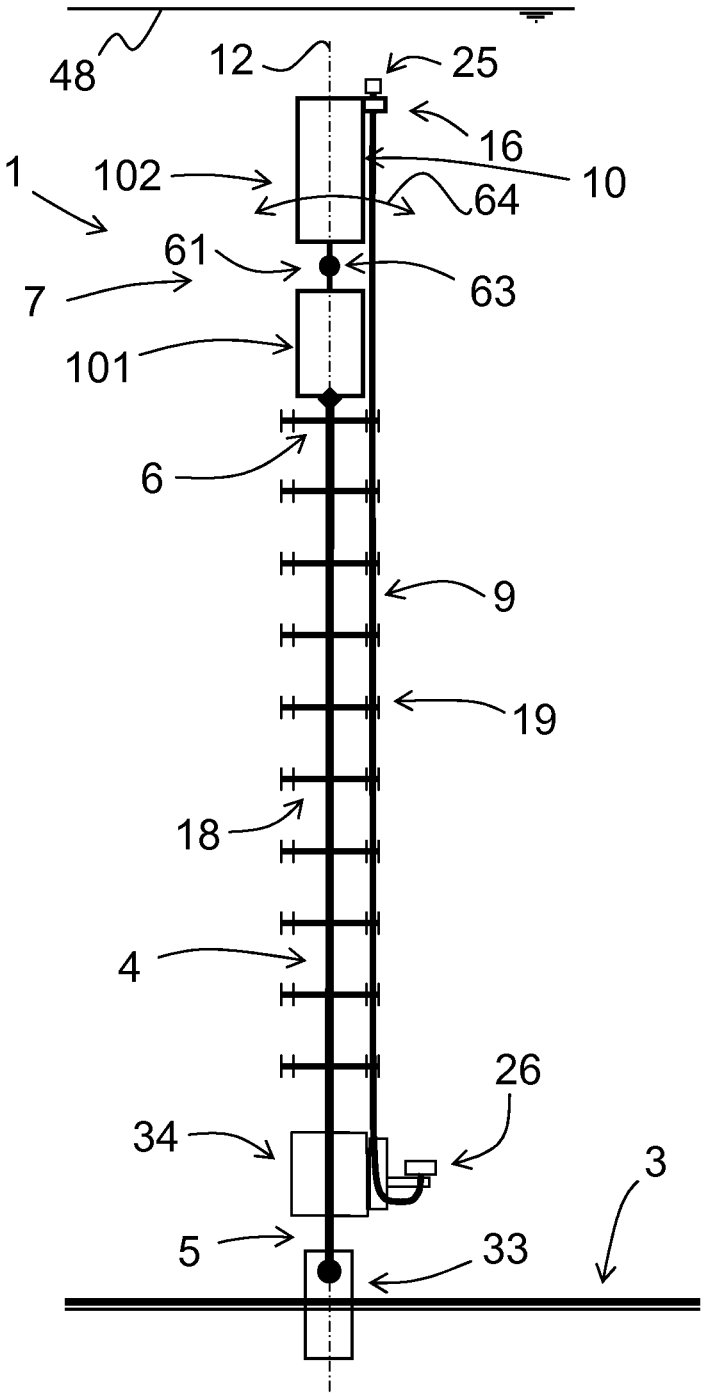

FIG. 26 schematically shows a side view of an alternative embodiment of the riser assembly 1 of FIGS. 1-7. The buoy 7 comprises a first buoy element 101 and a second buoy element 102 which are located substantially in line with the longitudinal frame axis 12. The second buoy element 102 is coupled to the first buoy element 101 by the buoy coupler 61. The buoy coupler 61 comprises a pivot coupling 63. This allows the second buoy element 102 to pivot relative to the first buoy element 101 as indicated by arrow 64. The pivot coupling 63 allows the second buoy element 102 to pivot in any direction relative to the first buoy element 101.

Figure 27:
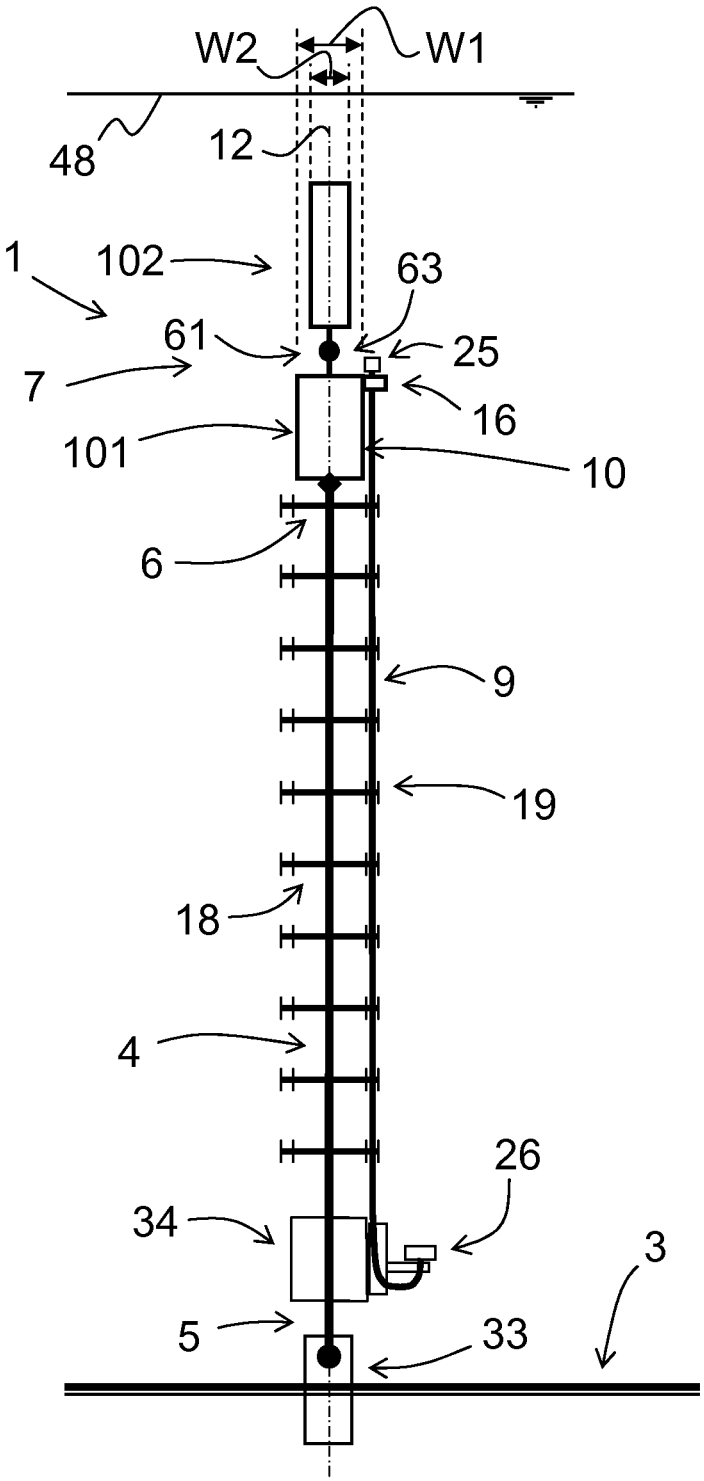

FIG. 27 schematically shows a side view of an alternative embodiment of the riser assembly 1 of FIGS. 1-7. The buoy 7 comprises a first buoy element 101 and a second buoy element 102. The riser 9 is connected to the buoy 7 at a location on the circumference 10 of the first buoy element 101. The width W1 of the first buoy element 101 is larger than the width W2 of the second buoy element 102.

Figure 28:
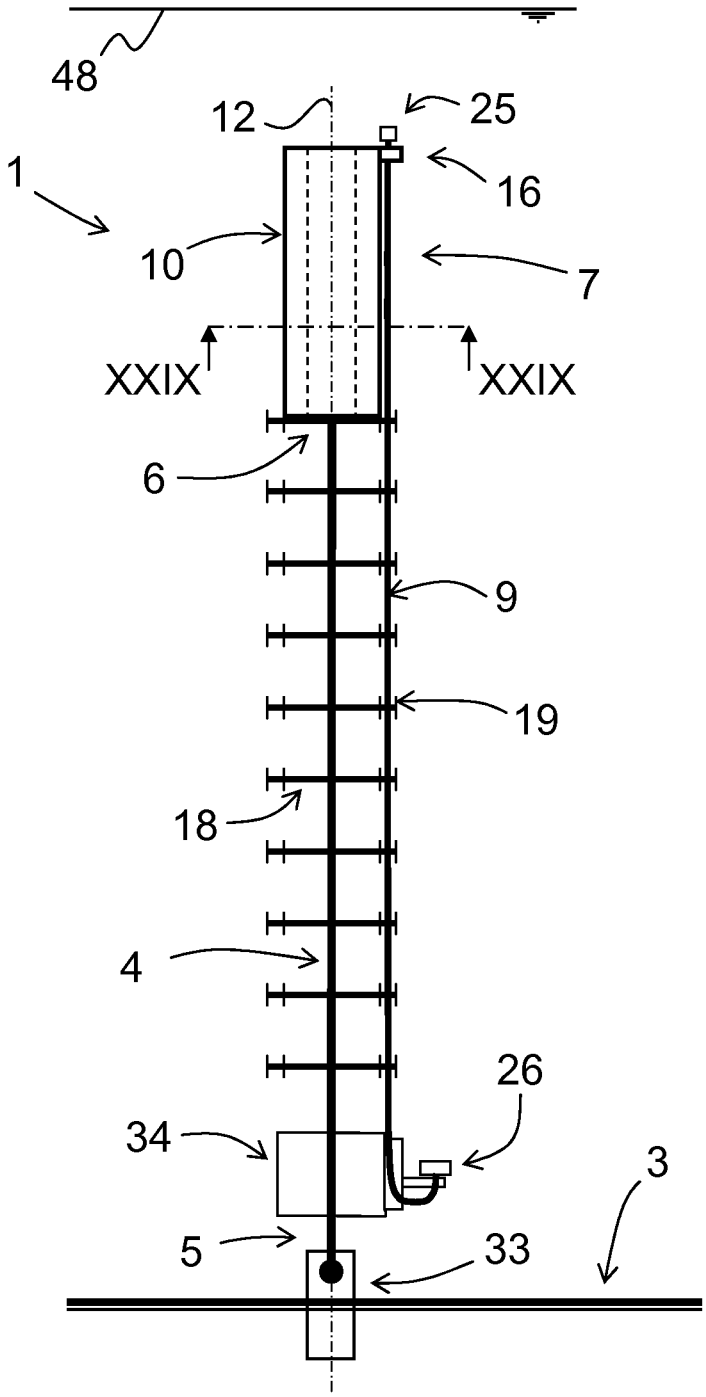
Figure 29:
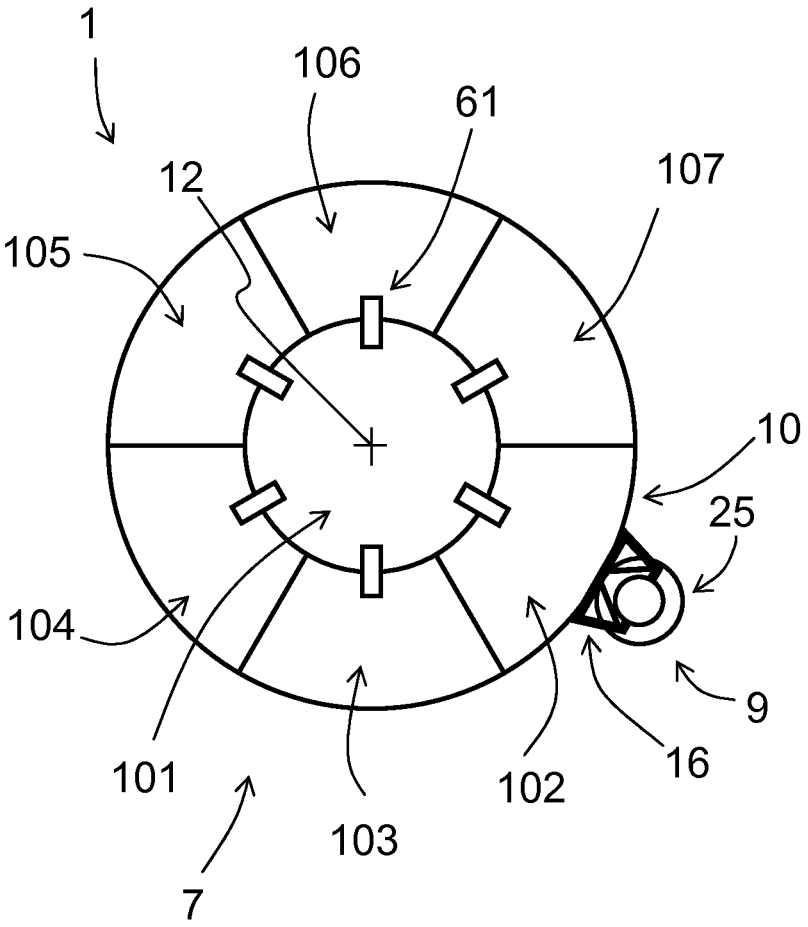

FIG. 28 schematically shows a side view of an alternative embodiment of the riser assembly 1 of FIGS. 1-7. FIG. 29 schematically shows a view in cross section along line XXIX-XXIX of the riser assembly of FIG. 28. Only one riser 9 is shown. The buoy 7 comprises seven buoy elements 101-107. The first buoy element 101 is positioned in line with the longitudinal frame axis 12 of the elongate frame 4. The six further buoy elements 102-106 are connected to the first buoy element 101 via buoy couplers 61.

The seven buoy elements 101-107 are located in a fictive plane extending substantially perpendicular to the longitudinal frame axis 12. The first buoy element 101 is surrounded by the six further buoy elements 102-107. The riser 9 is connected to the second buoy element 102. One or more risers 9 may be connected to each of the six further buoy elements 102-107. Each further buoy element 102-107 may be installed together with the thereto connected at least one riser 9.

Figure 30:
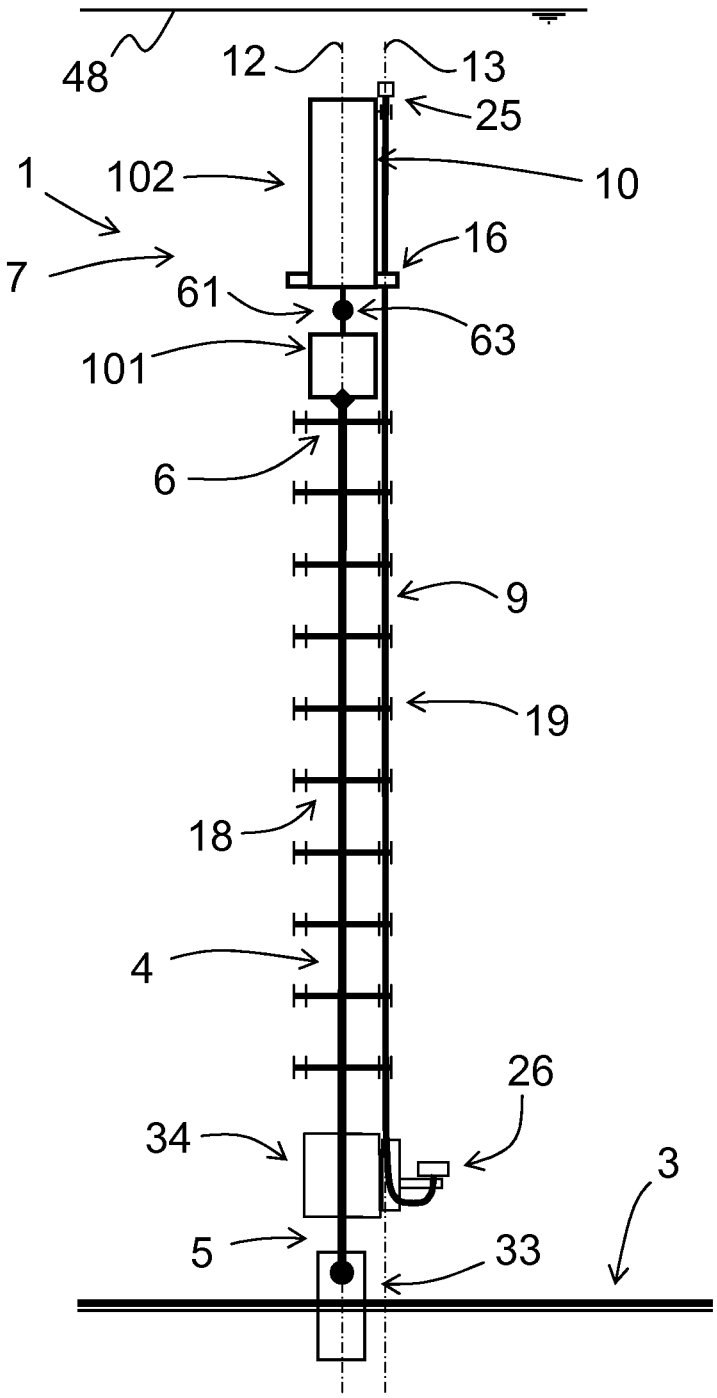

FIG. 30 schematically shows a side view of an alternative embodiment of the riser assembly 1 of FIGS. 1-7. The buoy 7 comprises a first buoy element 101 and a second buoy element 102. The riser 9 is connected to the lower part of the second buoy element 102 via the support device 16. At the upper part of the second buoy element 102, the riser 9 is held such that the riser 9 is movable in the direction of the longitudinal riser axis 13 and that movement in the direction perpendicular to the longitudinal axis 13 is prevented. The riser 9 is held at the upper part of the second buoy element 102 in a manner corresponding to the way the riser 9 is held by the limiters 19 as shown in FIG. 24. The riser 9 may at the upper part of the second buoy element 102 be held in any different suitable manner.

Figure 31:
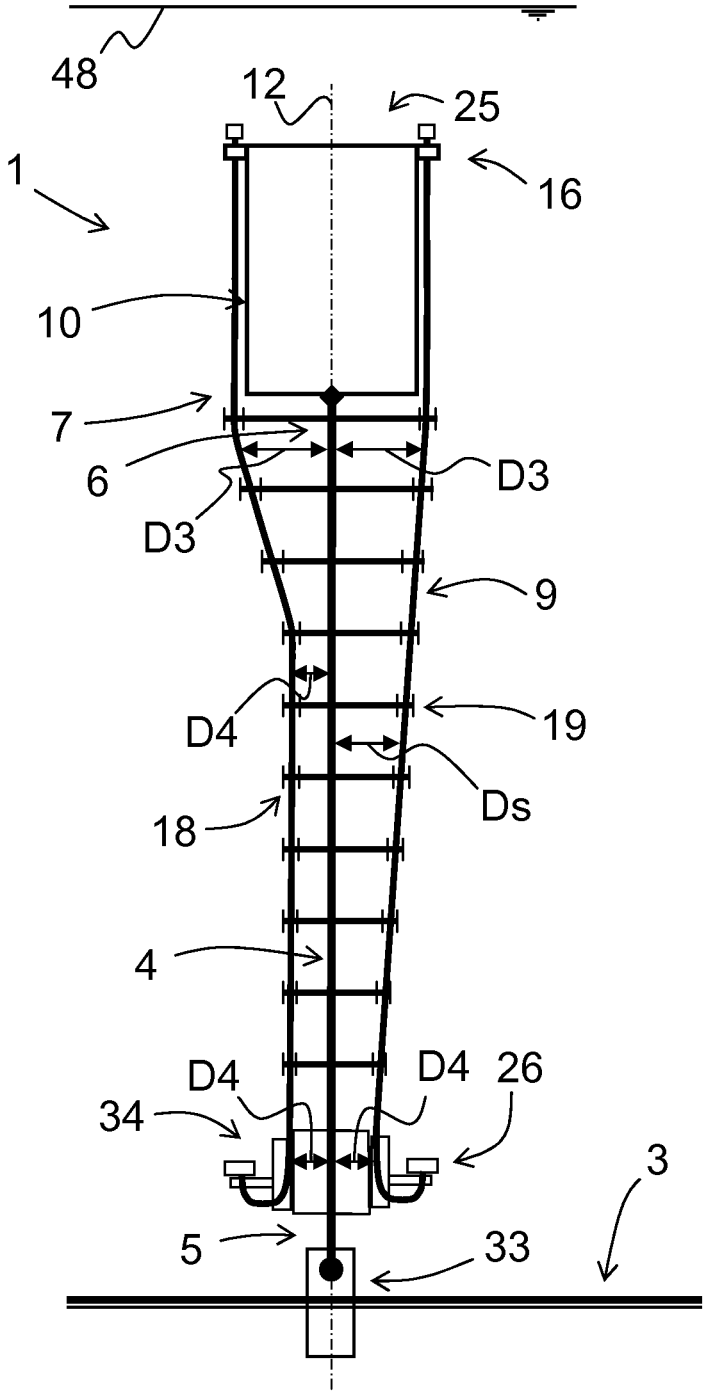

FIG. 31 schematically shows a side view of two alternative embodiments of the riser assembly 1 of FIGS. 1-7. The first alternative embodiment is shown at the right hand side of the riser assembly 1. The distance Ds between the centre 40 of the limiters 19 and the longitudinal frame axis 12 increases in the direction from the first frame end 5 to the second frame end 6. The spacers 18 are dimensioned such that the riser 9 extends along a substantially straight line and that the part of the riser 9 located at the second frame end 6 is located at a larger distance (D3) from the longitudinal frame axis 12 than the distance (D4) of the part of the riser 9 located at first frame end 5.

The second alternative embodiment is shown on the left hand side of the riser assembly 1. Seen from the first frame end 5, the riser 9 at first extends substantially parallel to the longitudinal frame axis 12. This allows that a part, in the situation shown the majority, of the spacers 18 may have the same dimensions. During the parallel extending part of the riser 9, the distance between the riser 9 and the longitudinal frame axis 12 equals D4. At a certain location along the frame 4, the path of the riser 9 is deflected and the distance between the riser 9 and the longitudinal frame axis 12 increases until it reaches the distance D3 at the second frame end 6. This means that the transition from the distance D4 to D3 between the riser 9 and the longitudinal frame axis 12 is reached over a shorter length when compared with the configuration shown at the right hand side.

The distance D3 may be between 4 and 10 m or between 5 and 8 m. The distance D4 may be between 1 and 5 m or between 2 and 4 m.

Figure 32:
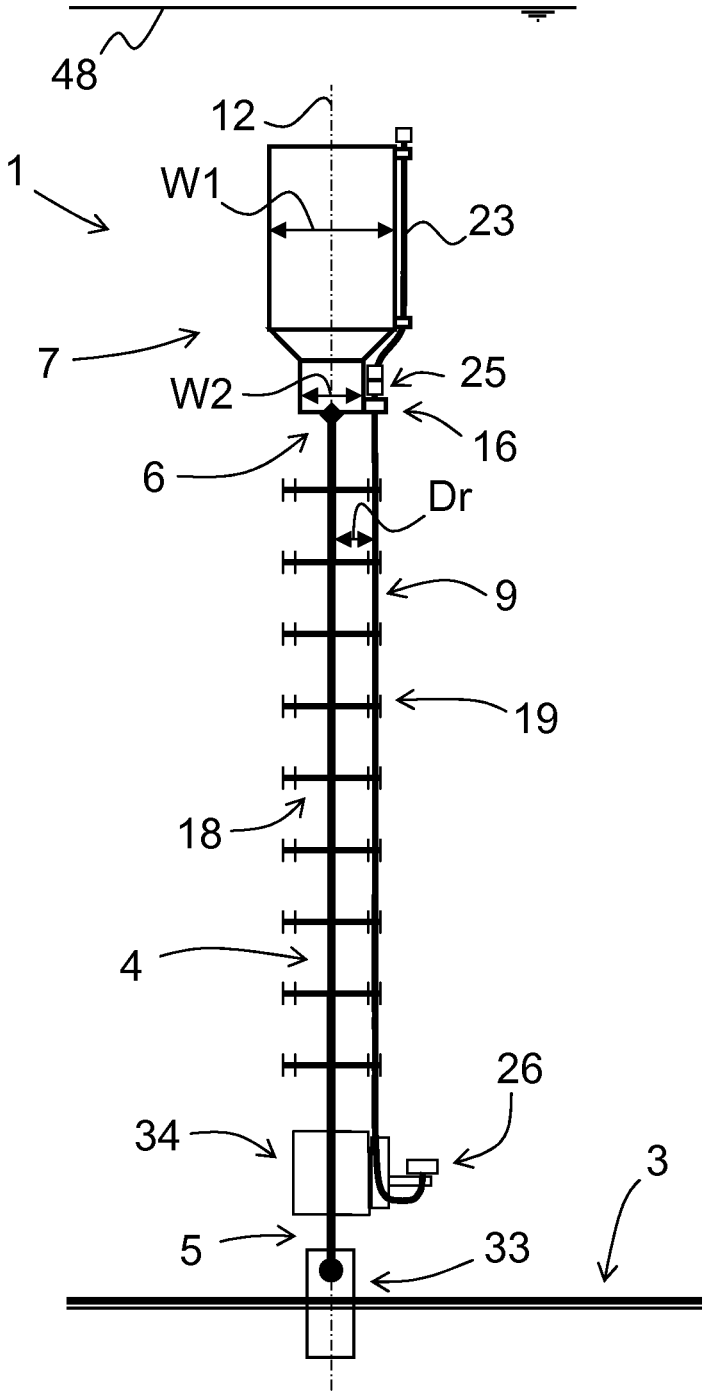

FIG. 32 schematically shows a side view of an alternative embodiment of the riser assembly 1 of FIGS. 1-7. The buoy 7 is located substantially in line with the longitudinal frame axis 12. The majority of the buoy 7 has a width W1. At the lower part, the buoy 7 has a smaller width W2. The riser 9 is connected by a connection 16 to said lower part of the buoy 7 with width W2. The part of the riser 9 extending upwardly from said connection 16 may be connected to the buoy 7 via connecting piping 23, such as a spool piece. The part of the riser 9 extending downwardly from said connection 16 to the first frame end 5 extends substantially parallel to the longitudinal frame axis 12 at a distance Dr. The distance Dr between the riser and the longitudinal frame axis 12 is smaller than half of the width W1 of the buoy 7 ($Dr<0.5\times W1$).

The FIGS. 33-40 schematically show an embodiment of the method of constructing the riser assembly of FIG. 25. The method has several steps similar to the method shown in the FIG. 10-20. Therefore, the FIG. 33-40 mainly show the steps that differ from the ones shown in the FIG. 10-20.

Figure 33:
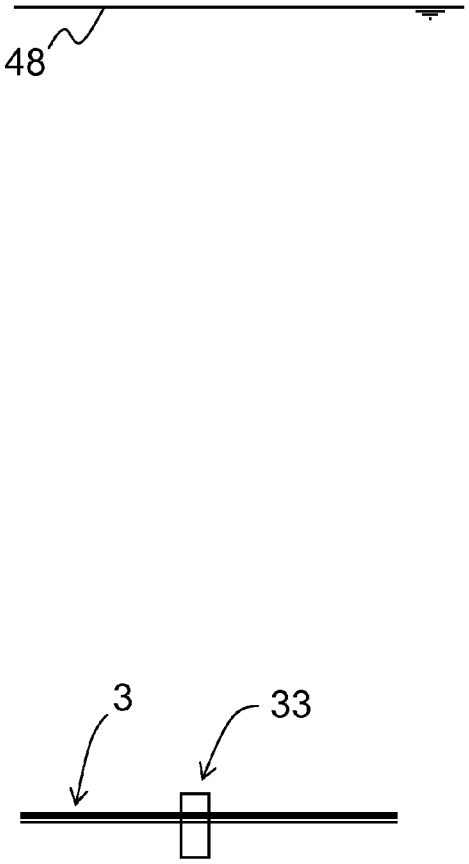

In FIG. 33 the waterline 48 and the seabed 3 are shown 33. A foundation 33 is provided in the seabed 3. The foundation 33 can for instance be a suction pile, a driven pile or a ballast foundation. The installation of the foundation 33 in the seabed 3 is performed from a vessel 2.

Figure 34:
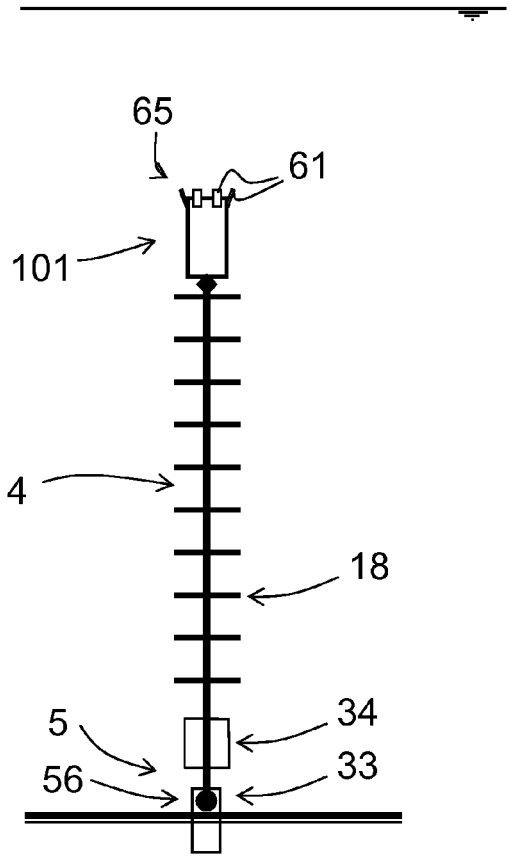

In FIG. 34 the frame 4 is build up from the vessel and connected to the seabed 3 via the foundation 33. More specifically, the first frame end 5 of the frame 4 is connected to the foundation 33. The first buoy element 101 is connected to the frame 4. The connection of the first buoy element 101 to the frame 4 is performed from a vessel 2. The first buoy element 101 is connected to the frame 4 before the frame 4 is connected to the foundation 33. The first buoy element 101 is configured such that the buoyancy thereof positions the frame 4 in an upright position. The first buoy element 101 may be connected to the frame 4 after the frame 4 is connected to the foundation 33.

A foundation connector 56 is used to connect the frame 4 to the foundation 33. The foundation connector 56 is locked in a receptacle provided on the foundation 33. Various Other types of foundations connectors 56 are known in the art and may be used.

The frame 4 may consist of tendon elements. The tendon elements may be connected via mechanical connectors or via welding. Other types of frames 4 may be used.

The first buoy element 101 comprises a buoy coupler 61 to connect the second buoy element 102 to the first buoy element 101. The buoy coupler 61 is in an open position 65.

Figure 35:
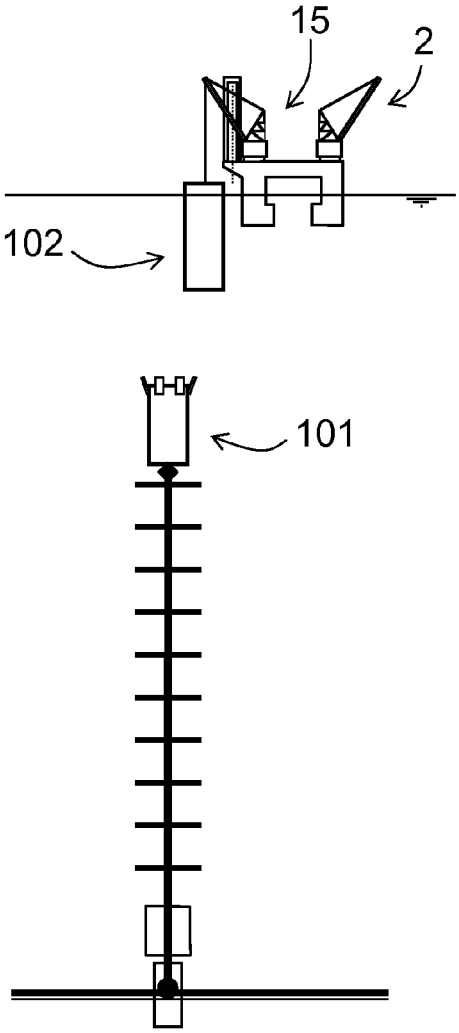

In FIG. 35 the second buoy element 102 is lowered into the water by the vessel 2, for instance by using a crane 15. A different lifting device 14 may be used.

Figure 36:
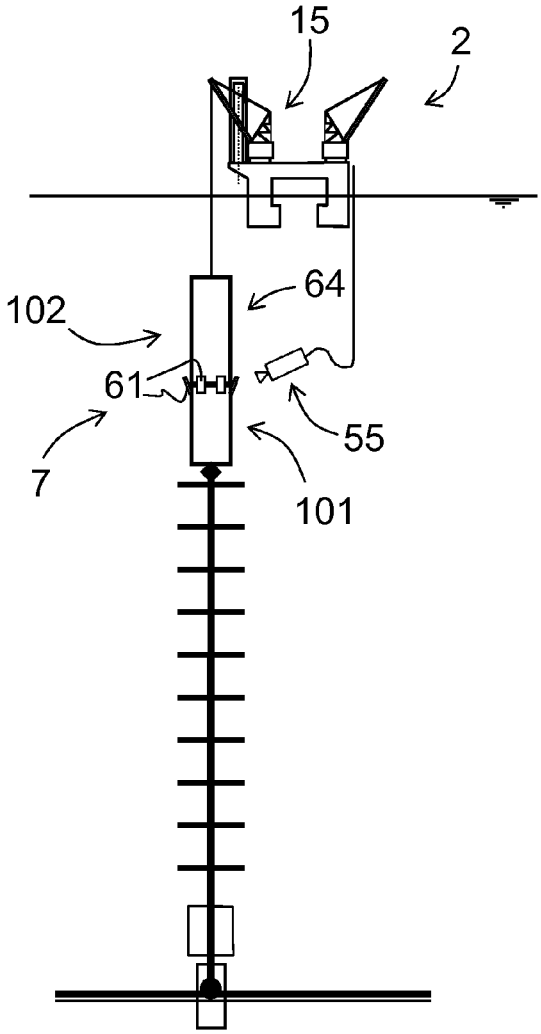

In FIG. 36 the second buoy element 102 is suspending from the vessel 2 and held in a position above and adjacent or on the first buoy element 101. The second buoy element 102 is positioned in the coupling position 64 in which the second buoy element 102 will be coupled to the first buoy element 101 to form the buoy 7. The buoy coupler 61 may be configured such that the buoy coupler 61 engages the second buoy element 102 when the additional buoy 60 is in coupling position 64. When the additional buoy 60 is positioned in the coupling position 64, the buoy coupler 61 is placed in the closed position 66 (FIG. 37) to couple the second buoy element 102 to the first buoy element 101. The buoy coupler 61 may be controlled by a remotely operated vehicle (ROV) 55. Other types of buoy couplers 61, such as remotely operated or automatically closing couplers, may be used.

The second buoy element 102 is configured such that the buoyancy thereof in combination with the buoyancy of the first buoy element 101 (the buoy 7) is sufficient to position the fully installed riser assembly 1, including all the risers 9 and further equipment, in an upright position. During the installation, the first buoy element 101 and/or the second buoy element 102 may comprise water to lower the buoyancy thereof to facilitate the installation thereof.

Figure 37:
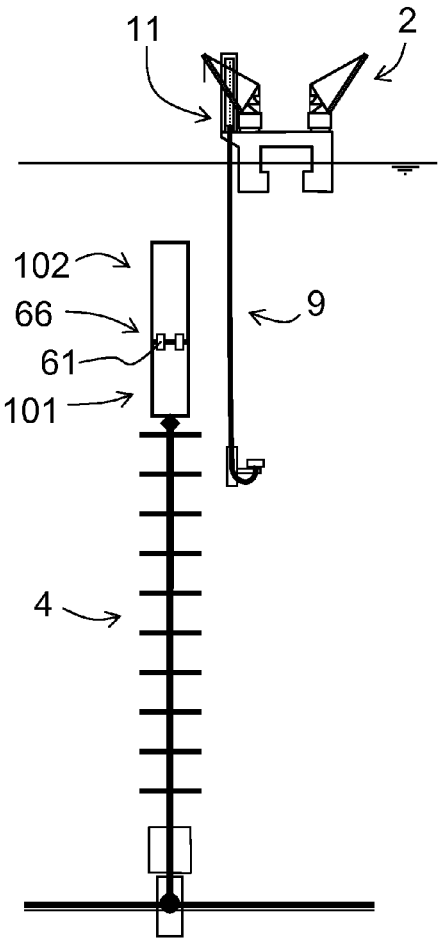

In FIG. 37 the second buoy element 102 is coupled to the first buoy element 101. In the situation that the first buoy element 101 and/or the second buoy element 102 comprises water, said water may be partly or completely removed to create tension in the elongate frame 4. A riser 9 is constructed on the vessel 2 by a J-lay pipeline construction process 11. A different pipeline construction process may be used.

Figure 38:
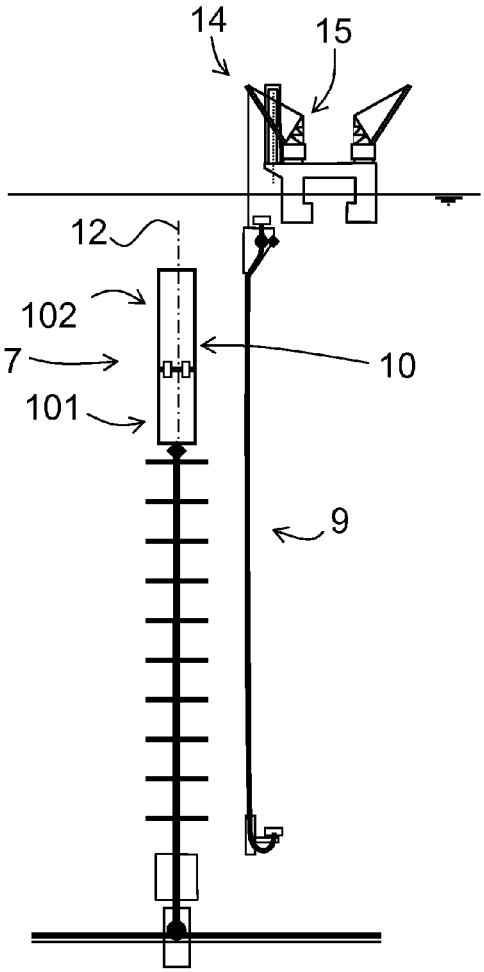

In FIG. 38 the completed riser 9 is suspending from the vessel 2. The riser 9 is positioned besides the frame 4 and buoy 7. The vessel 2 is used to move the riser 9 towards the frame 4 in a direction transverse to the longitudinal frame axis 12 of the frame 4.

Figure 39:
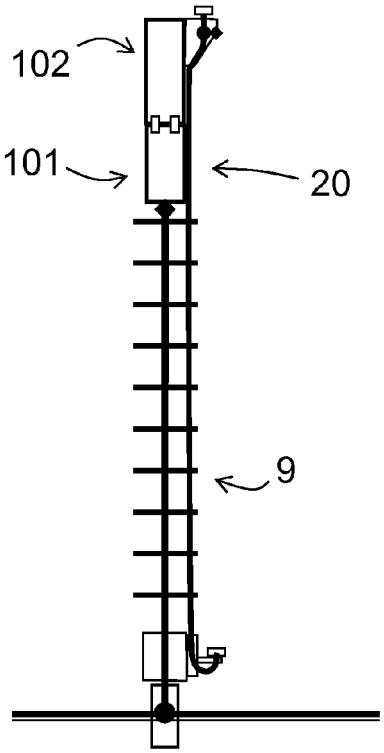

In FIG. 39 the riser 9 is connected to the second buoy element 102 and placed in the installed position 20.

Figure 40:
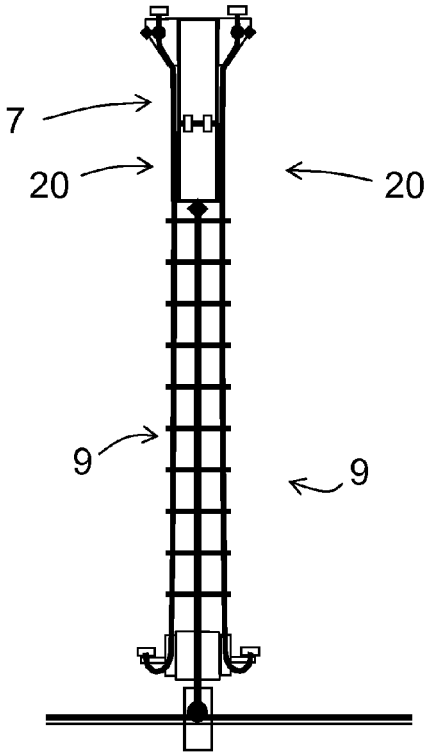

FIG. 40 shows the situation after the steps of FIG. 37-39 are repeated to connect more risers 9 to the buoy 7 and place them into the installed position 20. Additional steps corresponding to those shown in FIGS. 16 to 20, can be performed to complete the installation of the subsea pipeline system.

The dimensions of a construction that can be handled and installed by a vessel are limited by the capacity of the vessel. The dimensions of the construction may be limited by the height and the load bearing capacity of the lifting device, for example a crane located on the vessel.

The net buoyancy of a buoy is mainly determined by the volume and the weight thereof. The width, length and weight may form a limiting factor during handling and installation. The riser assembly and method according the invention comprising a buoy comprising at least two buoy elements allows the weight and size of a completely installed buoy to exceed the handling and installation capacity of the vessel.

Figure 41:
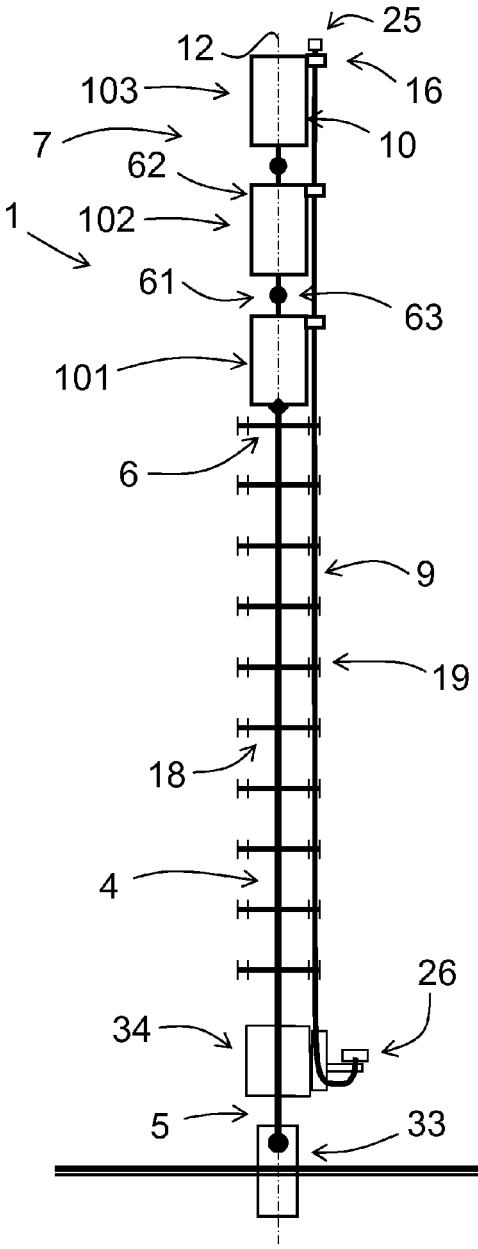

FIG. 41 schematically shows an alternative embodiment of the riser assembly of the FIGS. 1-7. The buoy 7 comprises a first buoy element 101, a second buoy element 102 and a third buoy element 103 which are located in line with the longitudinal frame axis 12.

Figure 42:
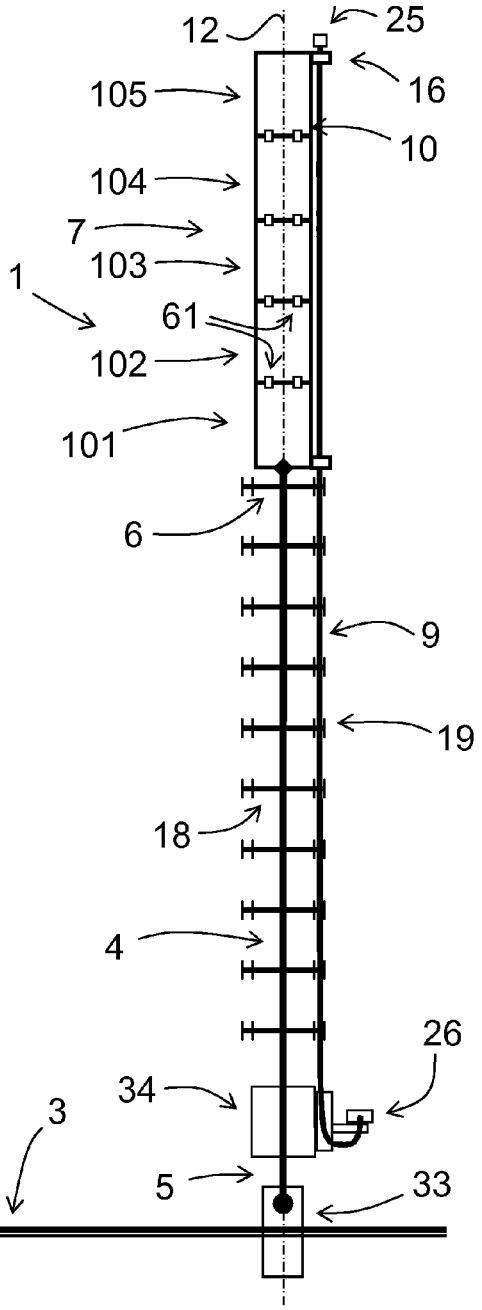

FIG. 42 schematically shows an alternative embodiment of the riser assembly of the FIGS. 1-7. The buoy 7 comprises five interconnected buoy elements 101-105 which are located in line with the longitudinal frame axis 12.

Figure 43:
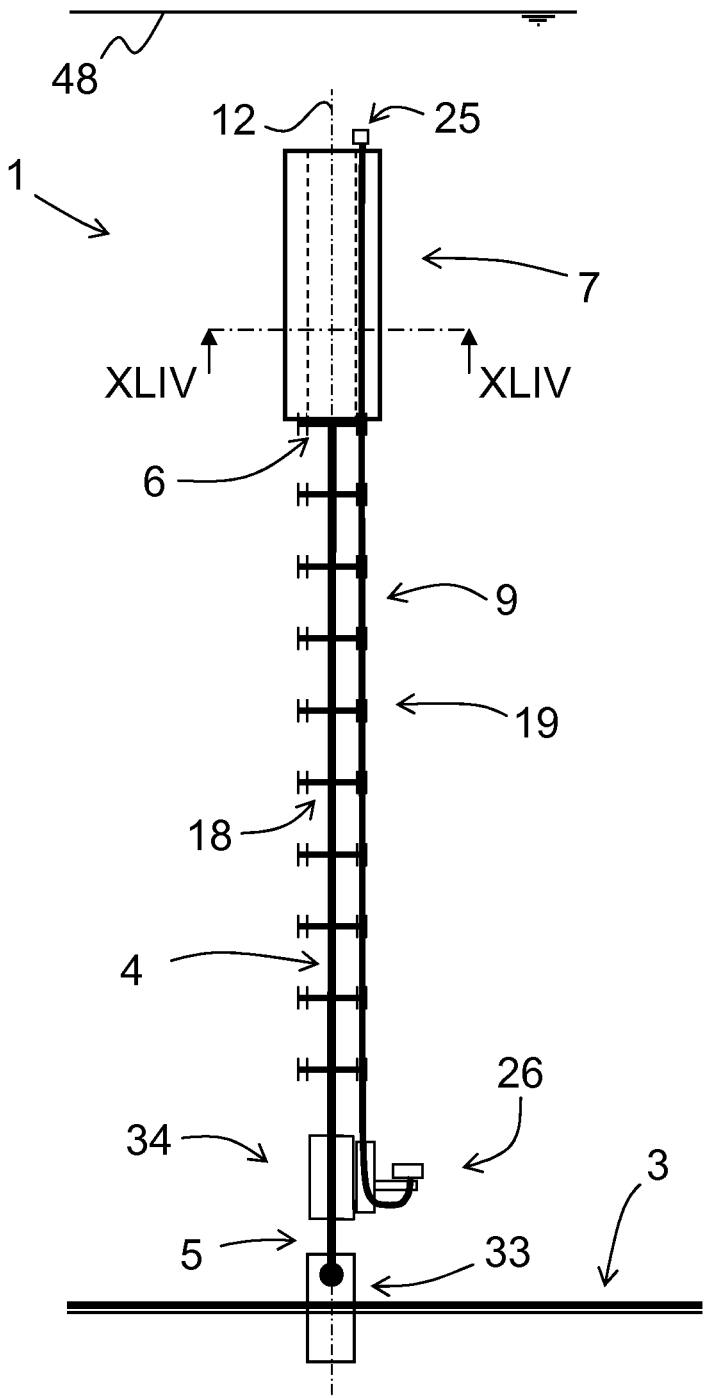
Figure 44:
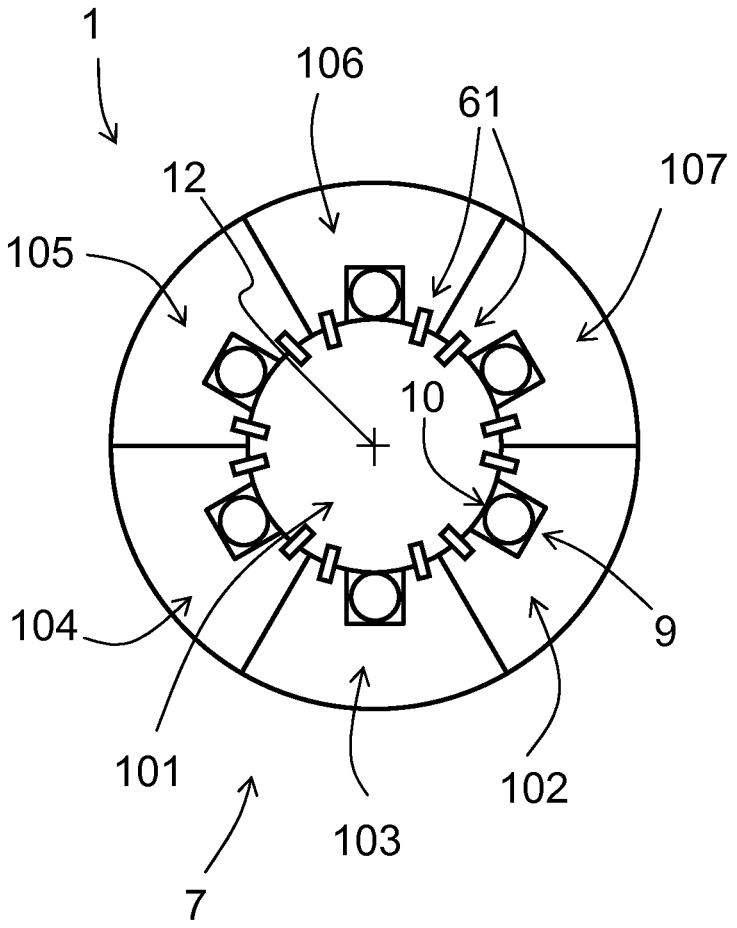

FIG. 43 schematically shows a side view of an alternative embodiment of the riser assembly 1 of FIGS. 1-7. FIG. 44 schematically shows a view in cross section along line XLIV-XLIV of the riser assembly of FIG. 43. The buoy 7 comprises seven buoy elements 101-107. The first buoy element 101 is positioned in line with the longitudinal frame axis 12 of the elongate frame 4. The six further buoy elements 102-107 are connected to the first buoy element 101 via buoy couplers 61. FIG. 43 shows one riser 9 and FIG. 44 shows six risers 9 connected to the buoy 7. The risers 9 are located at the circumference 10 of the first buoy element 101 and are surrounded by the further buoy elements 102-107.

The seven buoy elements 101-107 are located in a plane extending substantially perpendicular to the longitudinal frame axis 12. The first buoy element 101 is surrounded by the six further buoy elements 102-107. The riser 9 is connected to the second buoy element 102. The further buoy elements 102-107 may each be installed together with a riser 9 connected thereto. The risers 9 may be connected to the first buoy element 101.

It will be apparent to those skilled in the art that various modifications can be made to the riser assembly and method without departing from the spirit and scope of the invention.

The following clauses are presented as a further description of the method and riser assembly.

1. Method for constructing a riser assembly for transporting a fluid from a vessel and on a seabed, comprising;
   providing an elongate frame comprising a first frame end and a second frame end,
   wherein the first frame end is connected to the seabed and the second frame end is connected to a buoy,
   providing at least one riser for transporting a fluid,
   connecting the at least one riser to the second frame end and/or the buoy.

2. Method according to clause 1, wherein the method comprises connecting the at least one riser to the second frame end and/or the buoy at a location near the circumference of the buoy.

3. Method according to clause 1, wherein the method comprises connecting the at least one riser to the second frame end and/or the buoy at a location adjacent to the circumference of the buoy.

4. Method according to clause 1, wherein the method comprises connecting the at least one riser to the buoy at a location on the circumference of the buoy.

5. Method according to any of the preceding clauses, wherein the elongate frame comprises a longitudinal frame axis.

6. Method according to any of the preceding clauses, wherein the method comprises constructing the at least one riser by a pipeline construction process on the vessel.

7. Method according to any of the preceding clauses, wherein the pipeline construction process comprises a J-lay pipeline construction process and/or S-lay pipeline construction process and/or pipeline reeling process.

8. Method according to any of the preceding clauses, wherein the method comprises constructing the at least one riser while the vessel is positioned at a relatively large distance from the buoy connected to the frame.

9. Method according to any of the preceding clauses, wherein during the construction of the at least one riser the vessel is located at a distance of at least 10 m from the buoy.

10. Method according to any of the preceding clauses in combination with clause 5, wherein the method comprises connecting the at least one riser to the second frame end and/or the buoy at a distance of at least 1 m from the longitudinal frame axis of the elongate frame.

11. Method according to any of the preceding clauses and in combination with clause 5, wherein the method comprises connecting the at least one riser to the second frame end and/or the buoy at a distance of at most 10 m from the longitudinal frame axis of the elongate frame.

12. Method according to any of the preceding clauses and in combination with clause 5, wherein the method comprises connecting multiple risers to the second frame end and/or the buoy such that said risers surround the longitudinal frame axis of the elongate frame.

13. Method according to any of the preceding clauses and in combination with clause 5, wherein the method comprises connecting the at least one riser to the second frame end and/or the buoy such that at least one riser extends substantially parallel with the longitudinal frame axis of the elongate frame.

14. Method according to any of the preceding clauses, wherein the method comprises connecting the at least one riser to the second frame end and/or the buoy while the at least one riser is suspending from a lifting device provided on the vessel.

15. Method according to any of the preceding clauses, wherein the method comprises positioning the at least one riser besides the frame and/or the buoy, while the at least one riser is suspending from the vessel.

16. Method according to any of the preceding clauses and in combination with clause 5, wherein the method comprises moving the at least one riser located besides the frame and/or the buoy in a direction transverse to the longitudinal frame axis of the elongate frame into a position wherein the at least one riser is located adjacent to the second frame end and/or the buoy.

17. Method according to any of the preceding clauses and in combination with clause 5, wherein the method comprises moving the at least one riser located besides the frame and/or the buoy in a direction substantially perpendicular to the longitudinal frame axis of the elongate frame into a position wherein the at least one riser is located adjacent to the second frame end and/or the buoy.

18. Method according to any of the preceding clauses, wherein the method comprises connecting the at least one riser to the second frame end and/or the buoy by lowering the at least one riser on a support device provided on the second frame end and/or the buoy.

19. Method according to any of the preceding clauses, wherein the method comprises connecting the at least one riser to the second frame end and/or the buoy by lowering the at least one riser located adjacent to the second frame end and/or the buoy on a support device provided on the second frame end and/or the buoy.

20. Method according to any of the preceding clauses and in combination with clause 5, wherein the method comprises moving the at least one riser located besides the frame and/or the buoy in a direction transverse to the longitudinal frame axis of the elongate frame into a position wherein the at least one riser is in contact with the second frame end and/or the buoy.

21. Method according to any of the preceding clauses and in combination with clause 5, wherein the method comprises moving the at least one riser located besides the frame and/or the buoy in a direction substantially perpendicular to the longitudinal frame axis of the elongate frame into a position wherein the at least one riser is in contact with the second frame end and/or the buoy.

22. Method according to any of the preceding clauses, wherein the method comprises connecting the at least one riser to the second frame end and/or the buoy by lowering the at least one riser being in contact with the second frame end and/or the buoy on a support device provided on the second frame end and/or the buoy.

23. Method according to any of the preceding clauses, wherein the method comprises constructing the elongate frame by a frame construction process on the vessel.

24. Method according to any of the preceding clauses, wherein the frame construction process comprises a J-lay pipeline construction process and/or S-lay pipeline construction process and/or pipeline reeling process.

25. Method according to any of the preceding clauses, wherein the method comprises constructing the frame by interconnecting tendon elements via a welding process.

26. Method according to any of the preceding clauses, wherein the method comprises connecting the frame to the seabed while the frame is suspending from a lifting device provided on the vessel.

27. Method according to any of the preceding clauses, wherein the method comprises connecting the frame to the seabed by connecting the frame to a foundation provided in the seabed.

28. Method according to any of the preceding clauses, wherein the method comprises connecting the buoy to the frame on the vessel.

29. Method according to any of the preceding clauses, wherein the method comprises connecting the elongate frame with the thereto connected buoy to the seabed while the frame and buoy are suspending from a lifting device provided on the vessel.

30. Method according to any of the preceding clauses and in combination with clause 5, wherein the method comprises placing the at least one riser in an installed position wherein the movement of at least one riser relative to the frame and in a direction perpendicular to the longitudinal frame axis of the frame is limited.

31. Method according to any of the preceding clauses and in combination with clause 5, wherein the method comprises placing the at least one riser into an installed position wherein the movement of at least one riser relative to the frame and in a direction perpendicular to the longitudinal frame axis of the frame is prevented.

32. Method according to any of the preceding clauses, wherein the method comprises placing the at least one riser into an installed position wherein at least one riser is movable in the direction of the longitudinal riser axis.

33. Method according to any of the preceding clauses, wherein the method comprises placing the at least one riser into an installed position wherein at least one riser is allowed to shrink or elongate in the direction of the longitudinal riser axis.

34. Method according to any of clauses 30-33 and in combination with clause 5, wherein the elongate frame comprises multiple spacers for holding at least one riser, the spacers being positioned at a distance from each other along the longitudinal frame axis and the method comprises placing the at least one riser in the installed position wherein at least one riser is held by the spacers.

35. Method according to clauses 34, wherein the spacers comprise limiters for limiting the movement of a riser located in the installed position and the method comprises moving the at least one riser located besides the frame and/or the buoy in a direction transverse to the longitudinal frame axis of the elongate frame into a received position wherein the limiters at least partly surround the at least one riser.

36. Method according to clause 34 or 35, wherein the spacers comprise limiters for limiting the movement of a riser located in the installed position and the method comprises moving the at least one riser located besides the frame and/or the buoy in a direction substantially parallel to the longitudinal frame axis of the elongate frame into a received position wherein the limiters at least partly surround the at least one riser.

37. Method according to clause 35 or 36, wherein the limiters comprise a limiter opening and the method comprises moving the at least one riser in the received position by passing the at least one riser through the limiter opening.

38. Method according to any of the preceding clauses and in combination with any of the clauses 30-33, wherein the method comprises placing the at least one riser in the installed position by lowering the at least one riser being positioned near the second frame end and/or the buoy.

39. Method according to any of the clauses 1-37 and in combination with any of the clauses 30-33, wherein the method comprises placing the at least one riser in the installed position by lowering the at least one riser being positioned adjacent to the second frame end and/or the buoy.

40. Method according to any of the clauses 1-37 and in combination with any of the clauses 30-33, wherein the method comprises placing the at least one riser in the installed position by lowering the at least one riser being positioned in contact with the second frame end and/or the buoy.

41. Method according to any of the preceding clauses and in combination with any of the clauses 30-33, wherein the method comprises placing the at least one riser in the installed position by lowering the at least one riser located in the received position.

42. Method according to clauses 37, wherein the at least one riser comprises radial extending protruding members located at a distance from each other along a longitudinal riser axis of the at least one riser, the dimensions of the protruding members are chosen such that the protruding members can be placed in the received position wherein a passage of the protruding members through the limiter opening is blocked and the method comprises placing the riser in the received position and lowering the riser such that the protruding members are placed in the received position so that the riser is located in the installed position.

43. Method according to clause 42, wherein each protruding member has a length in which the protruding member extends along a longitudinal riser axis.

44. Method according to clause 42 or 43, wherein each of the protruding members has a different length and the method comprises moving the at least one riser in a direction of the longitudinal riser axis such that the protruding members are successively placed in the received position.

45. Method according to any of the clause 42-44, wherein the method comprises positioning the protruding members and the limiters such that by moving the at least one riser in a direction of the longitudinal riser axis, the protruding members are successively placed in or removed out of the received position.

46. Method according to any of the preceding clauses, wherein the at least one riser comprises a first riser end and a second riser end and the method comprises positioning the at least one riser such that the first end is located near the second frame end and/or the buoy and the second riser end is located near the seabed.

47. Method according to any of the preceding clauses, wherein the at least one riser comprises a first riser end and a second riser end and the method comprises positioning the at least one riser such that the first riser end is connected to the second frame end and/or the buoy and the second riser end is connected to the frame.

48. Method according to clause 46 or 47, wherein the method comprises moving the at least one riser in a first direction along the longitudinal riser axis such that the protruding member located the closest to the first riser end is placed as first in the received position.

49. Method according to any of the clauses 46-48, wherein the method comprises moving the at least one riser in an opposite second direction along the longitudinal riser axis such that the protruding member located the closest to the first riser end is placed as last out the received position.

50. Method according to any of the clause 46-49, wherein the method comprises moving the at least one riser in a first direction along the longitudinal riser axis such that the protruding member located the closest to the second riser end is placed as last in the received position.

51. Method according to any of the clauses 46-50, wherein the method comprises moving the at least one riser in an opposite second direction along the longitudinal riser axis such that the protruding member located the closest to the second riser end is placed as first out the received position.

52. Method according to any of the clauses 48-51, wherein the first direction is towards the seabed and the second direction is away from the seabed.

53. Method according to any of the preceding clauses, wherein the method comprises installing oil and/or gas processing equipment, such as one or more manifolds, on top of the buoy.

54. Method according to any of the preceding clauses, wherein the oil and/or gas processing equipment is constructed as a single unit and the method comprises installing said singe unit on top of the buoy.

55. Method according to any of the preceding clauses, wherein during installation of the oil and/or gas processing equipment on top of the buoy, the oil and/or gas processing equipment is suspending from a lifting device provided on the vessel.

56. Method according to any of the preceding clauses, wherein the buoy comprises at least two buoy elements.

57. Method according to clause 56, wherein the elongate frame comprises a longitudinal frame axis and the at least two buoy elements are positioned substantially in line with the longitudinal frame axis.

58. Method according to clause 56 or 57, wherein the method comprises connecting at least one buoy element to the second frame.

59. Method according to clause 58, wherein the method comprises connecting at least one buoy element to the at least one buoy element connected to the second frame end.

60. Method according to any of the clauses 56-59, wherein the method comprises connecting at least one of the buoy elements to at least one of the further buoy elements.

61. Method according to any of the clauses 56-60, wherein the method comprises interconnecting at least two buoy elements.

62. Method according to any of the clauses 56-60, wherein the method comprises interconnecting all the buoy elements.

63. Method according to any of the clauses 56-62, wherein the method comprises connecting all the buoy elements to the second frame end.

64. Method according to any of the clauses 56-62, wherein the elongate frame comprises a longitudinal frame axis and the at least two buoy elements comprise a first buoy element positioned substantially in line with the longitudinal frame axis.

65. Method according to clause 64, wherein the first buoy element and at least a part of the further buoy elements is positioned in a fictive plane extending transverse to the longitudinal frame axis.

66. Method according to clause 64, wherein the first buoy element and at least a part of the further buoy elements is positioned in a fictive plane extending substantially perpendicular to the longitudinal frame axis.

67. Method according to any of the clauses 64-66, wherein the first buoy element is at least partly surrounded by further buoy elements.

68. Method according to any of the clauses 64-66, wherein the first buoy element is substantially fully surrounded by further buoy elements.

69. Method according to any of the clauses 56-68, wherein at least one riser is positioned in a location near the circumference of the first buoy element.

70. Method according to any of the clauses 56-69, wherein at least one riser is positioned in a location near the circumference of at least one of the further buoy elements.

71. Method according to any of the clauses 56-70, wherein the elongate frame comprises a longitudinal frame axis and at least three buoy elements are positioned substantially in line with the longitudinal frame axis.

72. Method according to any of the clauses 56-64, 69 and 70, wherein the elongate frame comprises a longitudinal frame axis and all the buoy elements are positioned substantially in line with the longitudinal frame axis.

73. Method according to any of the clauses 56-72, wherein the buoy comprises a first buoy element and a second buoy element which are constructed such that the buoyancy of the second buoy element is larger than the first buoy element.

74. Method according to any of the clauses 56-73, wherein the buoy comprises a first buoy element and at least two further buoy elements which are constructed such that the buoyancy of the at least two further buoy elements is larger than the first buoy element.

75. Method according to any of the clauses 56-74, wherein the method comprises connecting at least one riser to at least one buoy element.

76. Method according to any of the clauses 56-75, wherein the method comprises connecting at least one riser to multiple buoy elements.

77. Method according to any of the clauses 56-76, wherein the method comprises connecting at least one riser to all the buoy elements.

78. Riser assembly for transporting a fluid, said riser assembly comprising;

an elongate frame comprising a first frame end and a second frame end, wherein the first frame end is connected to a seabed and the second frame end is connected to a buoy, and at least one riser for transporting a fluid, wherein the at least one riser is connected to the second frame end and/or the buoy.

79. Riser assembly according to any of the preceding clauses, wherein the at least one riser is connected to the second frame end and/or the buoy at a location near the circumference of the buoy.

80. Riser assembly according to any of the preceding clauses, wherein the at least one riser is connected to the second frame end and/or the buoy at a location adjacent to the circumference of the buoy.

81. Riser assembly according to any of the preceding clauses, wherein the at least one riser is connected to the buoy at a location on the circumference of the buoy.

82. Riser assembly according to any of the preceding clauses, wherein the riser assembly is constructed from a vessel according to any of the clauses 1-55.

83. Riser assembly according to any of the preceding clauses, wherein the elongate frame comprises a longitudinal frame axis.

84. Riser assembly according to any of the preceding clauses, wherein the at least one riser extend substantially parallel to the longitudinal frame axis of the frame.

85. Riser assembly according to any of the preceding clauses, wherein the riser assembly comprises multiple risers which are connected to the second frame end and/or the buoy such that said risers surround the longitudinal frame axis of the elongate frame.

86. Riser assembly according to any of the preceding clauses, wherein the at least one riser is located at a distance of at least 1 m from the longitudinal frame axis of the elongate frame.

87. Riser assembly according to any of the preceding clauses, wherein the at least one riser is located at a distance of at most 10 m from the longitudinal frame axis of the elongate frame.

88. Riser assembly according to any of the preceding clauses, wherein the at least one riser is suspending from the second frame end and/or the buoy.

89. Riser assembly according to any of the preceding clauses, wherein the at least one riser is suspending from a support device provided on the second frame end and/or the buoy.

90. Riser assembly according to any of the preceding clauses, wherein the at least one riser is held by the frame such that the movement of the at least one riser relative to the frame and in a direction perpendicular to the longitudinal frame axis of the frame is limited.

91. Riser assembly according to any of the preceding clauses, wherein the at least one riser is held by the frame such that the movement of the at least one riser relative to the frame and in a direction perpendicular to the longitudinal frame axis of the frame is prevented.

92. Riser assembly according to any of the preceding clauses, wherein the at least one riser is held by the frame such that the at least one riser is movable in the direction of the longitudinal frame axis of the frame.

93. Riser assembly according to any of the preceding clauses, wherein the elongate frame comprises multiple spacers for holding at least one riser, the spacers being positioned at a distance from each other along the longitudinal frame axis and the at least one riser is held by the spacers.

94. Riser assembly according to any of the preceding clauses, wherein the spacers comprise limiters for limiting the movement of the at least one riser held by the spacers.

95. Riser assembly according to any of the preceding clauses, wherein the at least one riser is at least partly surrounded by the limiters.

96. Riser assembly according to any of the preceding clauses, wherein the at least one riser which is partly surrounded by a limiter is located in a received position.

97. Riser assembly according to any of the preceding clauses, wherein the limiters comprise a limiter opening.

98. Riser assembly according to any of the preceding clauses, wherein the at least one riser comprises radial extending protruding members located at a distance from each other along the longitudinal riser axis and the dimensions of the protruding members are chosen such that the protruding members which partly surrounded by the limiters are blocked from a passage through the limiter opening.

99. Riser assembly according to any of the preceding clauses, wherein the at least one riser comprises radial extending protruding members located at a distance from each other along the longitudinal riser axis and the dimensions of the protruding members are chosen such that the protruding members which are located in the received position are blocked from a passage through the limiter opening.

100. Riser assembly according to any of the preceding clauses, wherein each protruding member has a length in which the protruding member extends along a longitudinal riser axis.

101. Riser assembly according to any of the preceding clauses, wherein each protruding member provided on the at least one riser has a different length.

102. Riser assembly according to any of the preceding clauses, wherein the distance between the protruding members of the at least one riser and/or between the limiters is chosen such that by moving the at least one riser in a direction of the longitudinal riser axis, the protruding members are successively placed in or out the received position.

103. Riser assembly according to any of the preceding clauses, wherein the at least one riser comprises a first riser end which is located near the second frame end and/or the buoy and a second riser end which is located near the seabed.

104. Riser assembly according to any of the preceding clauses, wherein the at least one riser comprises a first riser end which is connected to the second frame end and/or the buoy and a second riser end which is connected to the frame near the first frame end.

105. Riser assembly according to any of the preceding clauses, wherein the distance between the protruding members of the at least one riser and/or between the limiters is chosen such that;

by moving the at least one riser in a first direction along the longitudinal riser axis, the protruding member located the closest to the second riser end is placed as first in the received position.

106. Riser assembly according to any of the preceding clauses, wherein the distance between the protruding members of the at least one riser and/or between the limiters is chosen such that;

by moving the at least one riser in an opposite second direction along the longitudinal riser axis thereof, the protruding member located the closest to the second riser end is placed as last out of the received position.

107. Riser assembly according to any of the preceding clauses, wherein the distance between the protruding members of the at least one riser and/or between the limiter is chosen such that;

by moving the at least one riser in a first direction along the longitudinal riser axis thereof, the protruding member located the closest to the first riser end is placed as last in the received position.

108. Riser assembly according to any of the preceding clauses, wherein the distance between the protruding members of the at least one riser and/or between the limiter is chosen such that;

by moving the at least one riser in an opposite second direction along the longitudinal riser axis thereof, the protruding member located the closest to the first riser is placed as first out of the received position.

109. Riser assembly according to any of the preceding clauses, wherein the first direction is towards the seabed and the second direction is away from the seabed.

110. Riser assembly according to any of the preceding clauses, wherein the riser assembly comprises oil and/or gas processing equipment on top of the buoy.

111. Riser assembly according to any of the preceding clauses, wherein the oil and/or gas processing equipment comprises one or more manifolds.

112. Riser assembly according to any of the preceding clauses, wherein the oil and/or gas processing equipment is constructed as a single unit.

113. Riser assembly according to any of the preceding clauses, wherein the buoy comprises at least two buoy elements.

114. Riser assembly according to clause 113, wherein the elongate frame comprises a longitudinal frame axis and the at least two buoy elements are located substantially in line with the longitudinal frame axis.

115. Riser assembly according to clause 113 or 114, wherein at least one buoy elements is connected to the second frame.

116. Riser assembly according to clause 115, wherein at least one buoy element is connected to the at least one buoy element connected to the second frame end.

117. Riser assembly according to any of the clauses 113-116, wherein at least one buoy element is connected to at least one of the further buoy elements.

118. Riser assembly according to any of the clauses 113-117, wherein at least two buoy elements are interconnected.

119. Riser assembly according to any of the clauses 113-118, wherein all the buoy elements are interconnected.

120. Riser assembly according to any of the clauses 113-119, wherein all the buoy elements are connected to the second frame end.

121. Riser assembly according to any of the clauses 113-120, wherein the elongate frame comprises a longitudinal frame axis, the at least two buoy elements comprise a first buoy element located substantially in line with the longitudinal frame axis.

122. Riser assembly according to clause 121, wherein the first buoy element and at least a part of the buoy elements is located in a fictive plane extending transverse to the longitudinal frame axis.

123. Riser assembly according to clause 121, wherein the first buoy element and at least a part of the buoy elements is located in a fictive plane extending substantially perpendicular to the longitudinal frame axis.

124. Riser assembly according to any of the clauses 121-123, wherein the first buoy element is at least partly surrounded by further buoy elements.

125. Riser assembly according to any of the clauses 121-124, wherein the first buoy element is substantially fully surrounded by further buoy elements.

126. Riser assembly according to any of the clauses 113-125, wherein at least one riser is located near the circumference of the first buoy element.

127. Riser assembly according to any of the clauses 113-126, wherein at least one riser is located near the circumference of at least one of the further buoy elements.

128. Riser assembly according to any of the clauses 113-127, wherein the elongate frame comprises a longitudinal frame axis and the buoy comprises at least three buoy elements which are located substantially in line with the longitudinal frame axis.

129. Riser assembly according to any of the clauses 113-121, 126 and 127, wherein the elongate frame comprises a longitudinal frame axis and all the buoy elements are located substantially in line with the longitudinal frame axis.

130. Riser assembly according to any of the clauses 113-129, wherein the buoy comprises a first buoy element and a second buoy element which are constructed such that the buoyancy of the second buoy element is larger than the first buoy element.

131. Riser assembly according to any of the clauses 113-130, wherein the buoy comprises a first buoy element and at least two further buoy elements which are constructed such that the buoyancy of the at least two further buoy elements is larger than the first buoy element.

132. Riser assembly according to any of the clauses 113-131, wherein the at least one riser is connected to at least one buoy element.

133. Riser assembly according to any of the clauses 113-132, wherein the at least one riser is connected to multiple buoy elements.

134. Riser assembly according to any of the clauses 113-133, wherein the at least one riser is connected to all the buoy elements.

The invention claimed is:

1. A method for constructing a riser assembly for transporting a fluid from a vessel and on a seabed, comprising:

providing an elongate frame comprising a first frame end, a second frame end, and a longitudinal frame axis, wherein the first frame end is connected to the seabed and the second frame end is connected to a buoy;

providing at least one riser for transporting a fluid; wherein the method comprises moving the at least one riser located besides the frame or the buoy in a direction transverse to the longitudinal frame axis of the elongate frame into a position wherein the at least one riser is located adjacent to the second frame end or the buoy, and connecting the at least one riser to the second frame end or the buoy.

2. The method according to claim 1, wherein the method comprises connecting the at least one riser to the second frame end or the buoy at a location near the circumference of the buoy.

3. The method according to claim 1, wherein the method comprises moving the at least one riser located besides the frame and the buoy in a direction transverse to the longitudinal frame axis of the elongate frame into a position wherein the at least one riser is located adjacent to the second frame end and the buoy.

4. The method according to claim 1, wherein the method comprises connecting the at least one riser to the second frame end or the buoy by lowering the at least one riser on a support device provided on the second frame end or the buoy.

5. The method according to claim 1, wherein the method comprises connecting the frame to the seabed while the frame is suspending from a lifting device provided on the vessel.

6. The method according to claim 1, wherein the method comprises placing the at least one riser in an installed position wherein the movement of at least one riser relative to the frame and in a direction perpendicular to the longitudinal frame axis of the frame is limited.

7. The method according to claim 6, wherein the elongate frame comprises multiple spacers for holding at least one riser, the spacers being positioned at a distance from each other along the longitudinal frame axis and the method comprises placing the at least one riser in the installed position wherein the at least one riser is held by the spacers.

8. The method according to claim 7, wherein the spacers comprise limiters for limiting the movement of a riser located in the installed position and the limiters comprise a limiter opening and the method comprises moving the at least one riser located besides the frame or the buoy in a direction transverse to the longitudinal frame axis of the elongate frame into a received position, and wherein the limiters at least partly surround the at least one riser, and moving the at least one riser in the received position by passing the at least one riser through the limiter opening.

9. The method according to claim 7, wherein the spacers comprise limiters for limiting the movement of a riser located in the installed position and the limiters comprise a limiter opening and the method comprises moving the at least one riser located besides the frame or the buoy in a direction substantially parallel to the longitudinal frame axis of the elongate frame into a received position, and wherein the limiters at least partly surround the at least one riser, and moving the at least one riser in the received position by passing the at least one riser through the limiter opening.

10. The method according to claim 8, wherein the at least one riser comprises radial extending protruding members located at a distance from each other along a longitudinal riser axis of the at least one riser, the dimensions of the protruding members are chosen such that the protruding members can be placed in the received position wherein a passage of the protruding members through the limiter opening is blocked and the method comprises placing the riser in the received position and lowering the riser such that the protruding members are placed in the received position so that the riser is located in the installed position.

11. The method according to claim 10, wherein the method comprises positioning the protruding members and the limiters such that by moving the at least one riser in a direction of the longitudinal riser axis, the protruding members are successively placed in or removed out of the received position.

12. The method according to claim 1, wherein the method comprises installing oil or gas processing equipment on top of the buoy.

13. The method according to claim 1, wherein the method further comprises connecting the at least one riser to the second frame end and the buoy.

* * * * *